US012330032B2

(12) United States Patent
Holmes

(10) Patent No.: US 12,330,032 B2
(45) Date of Patent: Jun. 17, 2025

(54) GAME APPARATUS

(71) Applicant: TAKTIK PRODUCTS PTY LTD, Ivanhoe (AU)

(72) Inventor: Dean Holmes, Ivanhoe (AU)

(73) Assignee: TAKTIK PRODUCTS PTY LTD, Ivanhoe (AU)

( * ) Notice: Subject to any disclaimer, the term of this patent is extended or adjusted under 35 U.S.C. 154(b) by 380 days.

(21) Appl. No.: 17/927,244

(22) PCT Filed: May 20, 2021

(86) PCT No.: PCT/AU2021/050477
§ 371 (c)(1),
(2) Date: Nov. 22, 2022

(87) PCT Pub. No.: WO2021/232107
PCT Pub. Date: Nov. 25, 2021

(65) Prior Publication Data

US 2023/0201685 A1 Jun. 29, 2023

(30) Foreign Application Priority Data

May 22, 2020 (AU) ..... 2020901657

(51) Int. Cl.
*A63B 69/00* (2006.01)
*A63B 43/00* (2006.01)
(Continued)

(52) U.S. Cl.
CPC ..... *A63B 67/10* (2013.01); *A63B 43/007* (2013.01); *A63B 63/06* (2013.01);
(Continued)

(58) Field of Classification Search
CPC ..... A63B 67/10; A63B 43/007; A63B 63/06; A63B 69/0091
(Continued)

(56) References Cited

U.S. PATENT DOCUMENTS 5,275,396 A * 1/1994 Sudia ..... A63B 69/0091 473/427
5,454,561 A 10/1995 Smith
(Continued)

FOREIGN PATENT DOCUMENTS

CA 2 414 962 A1 2/2002
CN 207493144 U 6/2018
(Continued)

OTHER PUBLICATIONS

European Search Report dated Aug. 17, 2023 from corresponding European Patent Application No. 21806620.7, 7 pages.
(Continued)

*Primary Examiner* — Mitra Aryanpour
(74) *Attorney, Agent, or Firm* — Ruggiero McAllister & McMahon LLC

(57) ABSTRACT

This disclosure relates to a game apparatus including a housing, a motion measurement arrangement and a flexible tether. The motion measurement arrangement is at least partially located within the housing and includes a multi-axis pivot member movable relative to the housing in at least two axes. The motion measurement arrangement also includes a sensor arrangement for measuring multi-axis movement of the pivot member. The flexible tether has a free end coupled to a strikable object and a proximal end coupled to the pivot member. The motion measurement arrangement is configured to measure an indication of one or more parameters of the strikable object's motion upon striking of the strikable object by a user.

20 Claims, 14 Drawing Sheets

(51) Int. Cl.
*A63B 63/06* (2006.01)
*A63B 67/10* (2006.01)

(52) U.S. Cl.
CPC .... *A63B 69/0091* (2013.01); *A63B 2220/803* (2013.01); *A63B 2225/093* (2013.01); *A63B 2225/50* (2013.01)

(58) Field of Classification Search
USPC ..... 473/427, 429
See application file for complete search history.

(56) References Cited

U.S. PATENT DOCUMENTS

| | | | | |
|---|---|---|---|---|
| 5,605,326 | A | 2/1997 | Spear, Jr. | |
| 5,711,724 | A * | 1/1998 | McGovern | A63B 69/0091 473/427 |
| 6,257,989 | B1 * | 7/2001 | Tortola | A63B 69/3658 473/146 |
| 8,128,516 | B2 * | 3/2012 | Pan | A63B 69/0091 473/422 |
| 8,137,218 | B2 * | 3/2012 | Lesniewicz | A63B 69/38 473/430 |
| 9,283,458 | B2 * | 3/2016 | Achkar | A63B 71/0686 473/446 |
| 9,737,817 | B1 | 8/2017 | Ricky | |
| 10,695,636 | B2 * | 6/2020 | Mekonen | A63B 67/10 473/427 |
| 2015/0360107 | A1 | 12/2015 | Achkar | |

FOREIGN PATENT DOCUMENTS

| | | | |
|---|---|---|---|
| EP | 1 303 335 | B1 | 6/2007 |
| GB | 2558928 | A | 7/2018 |
| JP | 58-188476 | A | 11/1983 |
| JP | 51-15462 | B2 | 1/2013 |
| WO | 02/09826 | A1 | 2/2002 |
| WO | 2018/000030 | A1 | 1/2018 |

OTHER PUBLICATIONS

International Search Report dated Jun. 25, 2021 from corresponding International (PCT) Patent Application No. PCT/AU2021/050477, 5 pages.

Written Opinion dated Jun. 25, 2021 from corresponding International (PCT) Patent Application No. PCT/AU2021/050477, 5 pages.

International Preliminary Report on Patentability dated Aug. 5, 2021 from corresponding International (PCT) Patent Application No. PCT/AU2021/050477, 5 pages.

Chinese First Office Opinion Notice dated Feb. 22, 2025 from corresponding Chinese patent application No. 202180060142.5, 11 pages.

Japanese Office Action dated Jan. 28, 2025 from corresponding Japanese Application No. 2022-571808, 21 pages.

* cited by examiner

GAME APPARATUS

CROSS REFERENCE TO RELATED APPLICATIONS

This application is a national stage entry of International Application No. PCT/AU2021/050477 filed on May 20, 2021, which claims priority from Australian provisional patent application 2020901657 filed May 22, 2020, each of which is incorporated by reference into this specification in its entirety.

TECHNICAL FIELD

The present disclosure relates to a game apparatus for use in games in which a strikable object such as ball or the like is struck by a player. The present disclosure has been particularly developed for use as a tetherball apparatus and it will be convenient to describe the invention in the context of this exemplary application. However, it will be appreciated that the disclosure may also be used in other games such as totem tennis, swing ball, kickball, badminton etc. It will also be appreciated that the game apparatus of present disclosure may also be used as a training apparatus for training in batting or kicking games such as baseball, tennis, soccer, badminton and the like where a strikable object can be connected to a tether for training purposes.

BACKGROUND OF DISCLOSURE

The following discussion of the background to the present disclosure is intended to facilitate an understanding of the disclosure. However, it should be appreciated that the discussion is not an acknowledgement or admission that any of the material referred to was published, known or part of the common general knowledge as at the priority date of the application.

The game of tetherball involves a ball tethered to a stationary upright post and wherein opposing players on opposite sides of the post attempt to strike the ball in opposite directions using their hands or racquets. The object of the game is typically to strike the ball in such a way that an opponent is unable to counter the trajectory of the ball. Traditionally, the game ends when the tether becomes completely wound around the post such that no further rotation of the ball about the post is possible. In alternative versions of the game, the tethered end of the tether travels along a coil or helical member secured to the support post and the game ends when the tether is moved to the top or bottom of the helical member.

Electronic versions of tetherball and other tethered-ball games have been developed in which the rotation of the tether is capable of being detected by the apparatus via a digital counter or the like. These 'intelligent' or 'smart' tetherball apparatuses thereby help players keep score in a particular rally and/or keep score of the amount of rallies won by a particular player.

One such example is provided in Chinese Patent publication CN201721327839.1 in which a tether is connected to a pulling force inductor used to determine the force applied to the tether when the ball is struck. Another example is provided in US Patent publication 2015/0360107 which discloses a soccer training device in which a reed relay and magnet arrangement are used as a digital counter mechanism to record a player's kicks per minute. A further example is provided in International Patent Publication WO2018000030 which discloses a tetherball apparatus having pivot arm and an electronic sensor comprising a rotary encoder for sensing rotation of the pivot arm to measure speed, and direction of the pivot arm and to thereby infer speed, acceleration and direction of the ball.

Another example of a previous tetherball apparatus is provided in U.S. Pat. No. 5,454,561. This apparatus involved a tether coupled to a rotatable hub on the end of a horizontal arm. The apparatus further included a sensor for measuring rotation of the hub, relative to the arm. A further example is provided in UK patent application GB2558928. This system involved a bi-directional rotary encoder sensor arrangement allowing measurement of clockwise or anti-clockwise movement of the tether around a central post.

It is desirable to provide a new or alternative game or training apparatus which provides an improvement upon existing devices such as those noted above, or which alternatively provides an alternative choice for consumers.

Before turning to a summary of the disclosure, it will be useful to provide an explanation of some of the terms that will be used to define the spatial relationship of various parts thereof. In this respect, spatial references throughout this specification will generally be based upon an assembled game apparatus standing generally upright on a ground surface. With this environment as the basis, some parts may then be defined with reference to the surface and also to 'horizontal' and 'vertical', and allowing reference to "upper", "upwards", "lower", "downwards", "above", "below", "overhead", "underside", "top", "bottom" and the like. Further, it will be understood that a game apparatus housing has an interior and thus some parts may be defined with directional reference to "inner" and "outer".

SUMMARY OF DISCLOSURE

According to an aspect of the disclosure, there is provided a game apparatus including: a housing; a motion measurement arrangement at least partially located within the housing and comprising a multi-axis pivot member movable relative to the housing in at least two axes and a sensor arrangement for measuring multi-axis movement of the pivot member; and a flexible tether having a free end coupled to a strikable object and a proximal end coupled to the pivot member, the motion measurement arrangement being configured to measure an indication of one or more parameters of the strikable object's motion upon striking of the strikable object by a user.

The disclosure advantageously includes a multi-axis pivot member and associated sensor arrangement for detecting multi-axis movement of the pivot member. The multi-axis pivot member is capable of pivoting in multiple axes and the associated sensor arrangement is capable of detecting this multi-axis movement. This configuration provides additional degrees of freedom and additional measurement thereof as compared to existing systems which, in turn, facilitates improved measurement of indicators of the strikable object's motion. The motion measurement arrangement is configured to measure or infer an indication of the strikable object's motion via the measuring of the motion of the pivot member which is connected to the strikable object via the tether. It will be appreciated that motion of the strikable object induces movement in the tether and therefore movement of the pivot member via its coupling to the tether. Movement of the pivot member is therefore indicative of one or more parameters of the strikable object's motion.

Data produced by the motion measurement arrangement can therefore be analysed or interpreted to infer an indication of the strikable object's motion, for example to infer parameters of the strikable object's motion. For example, a measurement of the pivot's members acceleration, velocity or rotation can provide an indication of associated motion parameters of the strikable object. Consequentially, the additional degrees of freedom afforded to the pivot member, and the improved measurement thereof, enables improved detection and measurement of indicators of the movement of the strikable object as compared to existing systems which typically measure movement in a single axis or single degree of freedom.

For example, the soccer training device of US Patent publication 2015/0360107 discloses a reed relay configured to count the number of times that the tether revolves around the base but is otherwise unable to track or measure movement of the ball let alone in two axes.

Similarly, the tetherball apparatus disclosed in International Patent Publication WO2018000030 discloses a pivot arm configured only for axial rotation only around a central axis of the device. The rotary encoder of International Patent Publication WO2018000030 is therefore capable of detecting movement in only one degree of freedom and is therefore limited in the determinations and inferences which can be made regarding the ball's motion or trajectory.

Furthermore, previous tetherball systems using an L-type pivot member (including the device of International Patent Publication WO2018000030) tend to jar and tangle when the ball is hit with significant spin or mishit at a random angle. Even with the use of a swivel device in the tether, the tether can tend to twist and tangle which can restrict or influence free flight of the ball. The L-type design can be particularly overburdened when a player hits a shot with high amounts of spin or hits an elevated lob shot.

The present disclosure also provides a significant improvement over the earlier systems of U.S. Pat. No. 5,454,561 and GB2558928. Each of these systems were configured for recording bi-direction movement but only in a single axis. Neither system included a multi-axis pivot member or a sensor arrangement configured to record movement in more than one axis.

The present disclosure advantageously improves upon these systems by providing a pivot member having increased degrees of freedom so as to allow more natural ball flight as well as allow for increased measurement of ball trajectory and therefore improved gameplay or improved data generation during training.

The multi-axis pivot member may be configured in a variety of ways. According to a particular embodiment of the invention, the pivot member has a joystick configuration or is configured for joystick type motion. That is, the pivot member is configured for X-Y axis movement and whereby the pivot member can move (and can be measured) in two perpendicular axes. In addition to X-Y movement, the pivot member may further allow for axial movement around a Z axis perpendicular to both the X and Y axes.

The joystick type motion of the pivot member may be provided by a gimbal arrangement. For example, an X axis gimbal and a Y axis gimbal which permit movement of the pivot member in the X-Y axes. In this configuration, the pivot member may include a third gimbal or swivel allowing for axial rotation about the Z axis. The joystick configuration of the pivot member is particularly advantageous in that the pivot member is capable of tracking and measuring movement of the tether in an overhead trajectory, relative to the housing. In this way, a 'lob' or elevated trajectory of the strikable object can be more accurately tracked and measured. The motion measurement arrangement may therefore be configured to measure an indication of the strikable object's motion when travelling in an overhead trajectory, relative to the housing.

According to an alternative configuration, the pivot member is configured with a ball and socket configuration or a ball joint configuration. For example, the motion measurement arrangement may further comprise a socket and the pivot member has a ball portion engaged with the socket in a ball and socket configuration. A ball and socket configuration advantageously provides 3 degrees of freedom. In particular, allowing for X-Y axis movement of the ball portion as well as rotation about the Z axis without the need for separate gimbals or swivels. Furthermore, a ball and socket configuration may generally allow for smoother travel and movement as compared to a gimbal configuration.

The ball and socket configuration allows for the free arbitrary flight of the ball as it is struck by one or more players and can do so without tangling or without the need of a swivel type device where the cord joins the ball arm. This is due to the ball and socket configuration allowing free movement of the proximal end of the tether in both X and Y axis and also allowing for axial rotation of the pivot member about the Z axis (e.g. rotation of the arm about the arms own longitudinal axis). When spin is applied to the ball which in previous devices would cause twisting of the tether, the proximal end of the tether in the present invention induces rotation of the pivot member within the socket to thereby reduce or avoid tether twist and may also enable measurement of the ball spin.

The pivot member may generally be located at or adjacent an outer portion of the housing so as to permit connection to the tether. The position of the pivot member could otherwise vary and may depend on a particular game or apparatus. According to a particular embodiment of the invention, the pivot member is located at an upper portion of the housing. More particularly, the pivot member is centrally located and at or adjacent to the top of the housing. This configuration is particularly suited to games or sports where the strikable object is hit over the top of the housing such as badminton, tetherball or the like. Locating the pivot member at the top of the housing also facilitates the tether to move 360° around the housing such as the case in tetherball or kickball.

The ball and socket configuration may also provide enhanced weather resistance as compared to previous game or training apparatuses. In the case that the apparatus is left outside in the rain, the snug fit between the ball portion of the pivot member and the socket may advantageously prevent or minimise ingress of water, dust or other debris into the housing. The housing may further include a seal member, for example an O-ring, surrounding a volume or chamber of the housing beneath the socket. In the case that rain water made ingress through the ball and socket configuration, the O-ring could advantageously prevent any further ingress into the housing or into contact with electrical componentry. In a form of the present disclosure, the housing may include one or more selectively openable draining openings to enable drainage of water which ingresses through the ball and socket arrangement.

It is intended and expected that the ball and socket configuration of the pivot member therefore can allow a more realistic and functional solution for games or sports training in which a tethered object is struck by a user (i.e., a game player).

The strikable object of the present disclosure may comprise a ball such as a tennis ball, rubber ball or soccer ball. The strikable object may be suitable for striking with a user's hand. The strikable object may be suitable for striking with a bat or racquet or similar. The strikable object may be suitable for being kicked. In a particular embodiment of the disclosure, the strikable object comprises a shuttlecock. For example, in the case of the apparatus being used as a badminton game or badminton training device.

The tether may comprise any suitable flexible cord, line, rope, string, or other elongate flexible member. The tether may include a length adjustment device. The length adjustment device may allow for conversion of the apparatus to different games or training or to alter the dynamics of a particular game or to customise the tether length for particular players. For example, the tether may be adjusted to a suitable length for children. Typically, tether length may increase for older or stronger players and shorten for younger or shorter players. The tether length can be adjusted to allow for normal arm and body positioning. According to a particular embodiment, the tether length adjustment device comprises a clip through which tether can be fed and wound around the device. The device may include a fixing slot and aperture for receiving the winds of tether.

The proximal end of the tether could, in some embodiments of the disclosure, be coupled directly to the ball portion. Alternatively, the pivot member may include an arm extending from the ball portion similar to a human shoulder or hip joint configuration. In this configuration, the proximal end of the tether could be coupled to the arm, for example, a distal end of the arm. The pivot member arm may project outside of the housing in which case the connection between the tether and the pivot member is therefore also outside of the housing.

The motion measurement arrangement can be said to be partially located within the housing in that portions of the motion measurement arrangement are within the housing and portions of the sensor arrangement extend outside of the housing. In particular, the sensor arrangement and ball portion of the pivot member can be positioned within the housing but the arm of the pivot member projects outside of the housing.

Accordingly, in an embodiment of the present disclosure the pivot member includes an arm extending from the ball portion and projecting outside of the housing and wherein the proximal end of the tether is coupled to the arm. In one form of the invention, the arm extends upwardly from the housing. The arm may extend through an opening in the housing and wherein the ball and socket configuration permits free movement of the arm within the opening. For example, the ball and socket configuration may allow the arm to move freely within a boundary defined by the opening. A particular configuration may allow for the arm to contact an edge surface of the opening and move across the edge surface. The opening may be generally round or circular in configuration. In a particular embodiment of the disclosure, the arm is permitted to move 360° around the opening.

The opening may be configured to guide movement of the arm in a particular direction. For example, the shape or configuration of the opening may allow movement of the arm to a certain angle. The opening may define a boundary within which the pivot arm is free to move and whereupon contact between the edge of the opening and the pivot arm prevents the pivot arm from moving beyond a predetermined range of movement.

The edge surface of the opening may be angled relative to vertical. For example, the opening may have tapered or inclined edge surfaces. The opening may have a funnel or flared or partially conical or frustoconical configuration. An upper portion of the opening may be larger than a lower portion of the opening. The opening may comprise a funnel-shaped passage which widens towards its upper portion. The opening may be cone-shaped. For example, the edge surface of the opening may have a cone configuration.

According to a particular embodiment of the disclosure, the opening is flared and the arm is permitted to move freely within a conical-shaped zone defined by the opening. The conical zone is defined by an inclined edge surface of the flared opening. The distal end of the arm to which the proximal end of the tether is connected can move along a dish-shaped path. According to a particular embodiment of the invention, the edge surface of the flared opening is inclined at 40° to a central axis of the housing. The arm may therefore move in an 80° range of movement from one side of the opening to the other. The range of movement of the pivot member may be determined by the parameters of the sensor arrangement and the inclination of the surface of the flared opening surrounding the pivot member may vary depending on the particular sensor arrangement used. Accordingly, it will be appreciated that the inclination of the opening surface may vary.

In many applications of the present disclosure, the housing will generally be in an upright orientation so that the central axis of the housing will usually be vertical or near vertical. Although it will be appreciated that in particular applications the housing could be in a non-vertical orientation.

The proximal end of the tether may be removably coupled to the pivot member. For example, the proximal end of the tether may be connected to the pivot member via a tether fixing, tether clamp or other suitable tether connection. According to a particular embodiment of the invention the tether is removably coupled to the arm of the pivot member via a tether clamp nut configured for threaded engagement with an external thread on a portion of the arm of the pivot member. The proximal end of the tether may extend through one or more openings in the clamp nut and the clamp nut threaded onto the arm to clamp and thereby couple the proximal end of the tether to the arm. The tether may be fed through an opening in a side of the clamp nut. Alternatively, the clamp nut may include an opening in a top end of the clamp nut.

The ball portion of the pivot member could be provided in different shapes or profile. According to one embodiment of the disclosure, the ball portion is hemispherical. For example, the pivot member may be supported on a flat underside by a bearing and include one or more additional bearings in contact with the curved portion of the hemisphere. According to another embodiment of the disclosure, the ball portion is generally spherical or has a spherical portion. It will be appreciated that the ball portion of the pivot member could have the arm extending from one side and may therefore have at least one projection such that does not form a perfect sphere but is otherwise spherical or has a spherical portion engages with the socket.

It will be appreciated that the socket which receives and engages the ball portion may have a corresponding shape so as to neatly receive the ball portion. The socket may have a corresponding concave surface for contacting an outer surface of the ball portion. The socket may include one or more concave bearing surfaces for contacting the ball portion of the pivot member.

The socket could be configured in a variety of ways but in a particular form of the invention the socket comprises a two-part bearing with each bearing part including a concave bearing surface for contacting the ball portion of the pivot member. The bearing surfaces may comprise inwardlyfacing annular and concave surfaces. The two bearing parts may comprise an upper bearing part and a lower bearing part. The two-part structure may enable or facilitate assembly. For example, the ball portion of the pivot member may be placed within the lower bearing part and the upper bearing part is then placed atop the lower bearing part to secure the ball portion of the pivot member in position. The socket, for example the bearing parts, may be secured to the housing and the ball portion of the pivot member secured within the socket so as to thereby secure the ball portion, relative to the housing. The bearing surfaces of the socket may be the only portion of the apparatus in contact with the ball portion of the pivot member. The bearing surfaces support and secure the pivot member relative to the housing whilst also facilitating movement of the pivot member relative to the housing.

The pivot member and socket may be formed from any suitable material. In a particular embodiment of the invention, the pivot member and socket are formed from dissimilar materials to facilitate low-friction operation. The pivot member may be formed of a light weight and polished metal material. The pivot member may be formed of a polymer. For example, the pivot member may be formed of an engineering grade plastic. The pivot member may comprise a composite material, for example glass-filled nylon. The socket/bearing may be formed of a low friction material such as Acetal or Teflon. The pivot arm and ball portion of the pivot member may be integrally formed. The pivot member may be substantially rigid or formed of a solid material.

The housing may similarly be formed of a rigid or solid material. For example, the housing may comprise rigid polymer. In particular, the housing may comprise Acrylonitrile butadiene styrene (ABS) or may comprise Acrylonitrile styrene acrylate (ASA).

The sensor arrangement of the present disclosure works in association with the pivot member to provide the motion measurement arrangement which is configured to measure parameters of the strikable object's motion. According to a particular form of the disclosure, the sensor arrangement includes a contactless sensor for detecting and measuring movement of the pivot member. For example, the sensor arrangement can include a sensor spaced apart from the pivot member and configured for contactless movement measurement of the pivot member.

The use of a contactless sensor arrangement provides a significant advantage as compared to sensors which require contact with a moving surface of the pivot member such as the case with the rotary encoders used in some prior art systems. The contactless sensor arrangement eliminates a source of friction allowing for less restricted and more natural movement of the pivot member. Moreover, the contactless sensor arrangement reduces or eliminates mechanical wear and tear by reducing the number of contacting components.

Furthermore, previous contacting sensors such as a rotary encoder are susceptible to becoming clogged with dirt, grime, salt, dust, etc. whereupon sensor accuracy would decline, and life expectancy is reduced. The use of a contactless sensor enables the sensor to be potentially separated from the pivot member and from any water, debris, etc. coming into contact with the pivot member. In one form of the disclosure, the sensor is secured within a weather-resistant portion of the housing and is separated from the pivot member by a wall, seal or other weather-resistant barrier which is sufficient to protect the sensor but configured so as not to interfere with contactless motion measurement of the pivot member. The housing may therefore be either water-proof or have a high degree of water-resistance.

In a particular form of the disclosure, the sensor is a multi-axis Hall effect sensor and the sensor arrangement further includes a magnet wherein the sensor is configured to measure movement of the magnet, relative to the Hall effect sensor. The magnet may be associated with the pivot member. In particular, the magnet may be in moving association with the pivot member. For example, the magnet may be secured to the pivot member. The Hall effect sensor may be a tri-axis Hall effect sensor capable of measuring X-Y movement of the magnet as well as rotation of the magnet. It will be appreciated by a person skilled in the art that Hall effect sensors are typically more reliable than rotary encoders. Furthermore, rotary encoders are undesirable and unreliable for high-velocity measurements whereas Hall effect sensors are better suited to the quick movements typical of a pivot member used in a game or sport training apparatus.

It will be appreciated by a person skilled in the art that upon a change in magnetic field (i.e., movement of the magnet) Hall effect sensors output a voltage which is indicative of the motion of the magnet. A Hall effect sensor may therefore advantageously enable contactless measurement of the pivot member and may also allow for a barrier or seal to be positioned between the sensor and the magnet. According to a particular form of the disclosure, the sensor is secured relative to the housing and the magnet is arranged for movement with the pivot member, relative to the housing. The magnet may be located within the pivot member or could be attached to the pivot member such that the magnet is in moving association with the pivot member. Alternatively, the magnet may be integrally formed as a portion of the pivot member itself. For example, at least part of the pivot member may be formed of a magnetic material.

In an alternative form of the present disclosure, the sensor arrangement could comprise an optical sensor and/or a capacitive accelerometer.

According to a particular form of the disclosure, the magnet is secured to a portion of the pivot member such as a surface of the pivot member. The magnet may be secured to an underside of the pivot member. In particular, the pivot member may include a projection extending from an underside of the ball portion and the magnet is mounted, secured or otherwise located on the projection.

The sensor may be positioned within the housing and beneath the magnet albeit potentially separated by a seal or weather barrier and sufficiently close to the magnet so as to enable the sensing of magnetic flux from the magnet. A larger or stronger magnet may potentially enable the sensor to be spaced farther from the magnet. It will be appreciated that the location, size, strength or other configuration could vary depending on the particular application of the present disclosure.

According to a particular embodiment of the disclosure, the sensor is mounted on a printed circuit board (PCB) secured within the housing and positioned beneath the pivot member. In alternative forms of the present disclosure, the PCB may be located at other positions, for example, to a side of the pivot member. In one form of the disclosure, the housing includes a dish-shaped or concave barrier positioned above the sensor/PCB and beneath the pivot member. In particular, the magnet is positioned within the dish (i.e., the concave portion) of the concave member but not in contact therewith.

The magnet's possible range of movement may generally correspond to a concave or dish-shaped three-dimensional path. The dish of the concave member may therefore be shaped to generally correspond with the magnet's possible range of movement and to maintain a space between the concave member and the magnet. In a particular embodiment of the disclosure, the concave member comprises a PCB support and the PCB is secured to an underside of the PCB support. The PCB support may be dish-shaped or include a dish-shaped (for example concave) portion in which the magnet is received or recessed. The concave portion may therefore surround or partially encompass the magnet. In a form of the invention, the sensor is centrally positioned with respect to the concave portion of the PCB support. The sensor may be positioned beneath the lowermost part of the concave portion. Both the ball portion of the pivot member and the sensor may be positioned along a central axis of the housing.

In an alternative form of the invention, the sensor arrangement could comprise a sensor which is located or integrated in or on the pivot member or otherwise in moving association with the pivot member. For example, an inertial sensor, 3D accelerometer or 3D gyroscope may be located within the pivot member. This alternative form of the invention may potentially allow for the size of the housing to be reduced if the sensor arrangement were self-contained within the pivot member. A pivot member with a self-contained sensor arrangement may further improve weather resistance of the apparatus.

According to an embodiment of the disclosure, the sensor arrangement is configured to measure an indication of the speed and direction of the strikable object. The sensor arrangement may also be configured to measure an indication of acceleration of the strikable object. An indication of acceleration may also be used to determine an indication of the force applied to the strikable object by a user. For example, the acceleration indication may be calculated by monitoring a change in velocity over time. The sensor arrangement may therefore include a timer and the pivot member motion data is recorded with a timestamp.

The sensor arrangement is configured to measure multi-axis movement of the pivot member and to infer parameters of the strikable object's motion from the movement/motion of the pivot member. As indicated above, the one or more sensors of the sensor arrangement may therefore be associated with the pivot member. For example, the sensor(s) may be located adjacent to the pivot member and/or within the housing. The sensor arrangement may therefore directly measure motion of the pivot member in order to indirectly measure or infer motion of the strikable object.

In another form of the present disclosure, the sensor arrangement could include one or more sensors associated with the strikable object so as to directly measure parameters of the strikable object's motion. For example, the sensor arrangement may include a 3D accelerometer and/or 3D gyroscope located on or within the strikable object. The strikable object sensors may be used to supplement the data provided by sensors measuring movement of the pivot member.

The parameters of the strikable object's motion may therefore enable assessment and display of game or training metrics. For example, measuring the direction of the strikable object may enable monitoring of which player is winning a particular game such as tetherball. Measuring an indication of acceleration or speed of the strikable object may enable monitoring of player performance metrics for training purposes. Or to provide game metrics such as the fastest strike of the game, maximum backhand, forehand, ball spin, % of shots returned, average improvement over time, number of hits, etc.

The housing of the present disclosure may be positioned or orientated as necessary to suit a particular game or form of sport training. For example, where the apparatus is configured for the game of soccer, the housing may be secured to a base on the ground. Alternatively, the housing could be secured to the ground directly for example the housing may include a pointed portion on its underside for driving into soil or sand.

In an embodiment of the disclosure, the apparatus includes an upright support member and the housing is mounted at an upper portion of the support member. For example, where the apparatus is used as a tetherball, badminton or tennis training apparatus, the housing may be elevated from ground by an upright support member so that the tether and strikable object are at an appropriate height for the particular sport or game. Where the disclosure is used as a soccer training apparatus, the support member may be relatively short such that the housing is closer to the ground to facilitate kicking of the strikable object.

The support member may comprise a support post or pole. The support member may have an adjustable length. For example, the support member may comprise several telescopic segments and a locking arrangement to lock telescopic movement of the segments relative to one another at a desirable height. The adjustable support member length may facilitate positional adjustment of the housing to suit different user heights. The adjustable length may also facilitate the apparatus to be used in a multi-game or multi-sport training apparatus whereby the housing position can be raised or lowered as desired for different games or sports. The support member may also be collapsible to facilitate storage.

In one form of the disclosure, the support member may be secured directly to the ground. For example, a lower end of the support member may be pointed to facilitate driving into soil or sand. The lower end of the support member may also be positioned within a suitable post anchor located in the ground. Alternatively, the apparatus may further include a base to which a lower portion of the support member is secured.

The base may be configured for use with a particular game or sport. For example, the base may require additional weight or size for games such as badminton or tetherball where the support post is relatively long and the leverage applied to the base via the support post during use is relatively high. Conversely, where the apparatus is used with a shorter support member such as in a soccer training device then a smaller or lighter base may be all that is required.

The base may comprise a container fillable with ballast material. For example, the base may be fillable with water or sand and may include an opening for filling and removing water from the base. Alternatively, the base could comprise a generally planar disc or sheet which is not fillable with ballast material.

The base may include a biasing arrangement to absorb shock and prevent the base from lifting during use. The biasing means may therefore enable higher force to be applied to the strikable object without the apparatus tipping over. The biasing means may comprise a spring, for example a helical spring for dampening movement of the support member during use. Alternatively, the biasing means may comprise a flexible member such as a flexible rubber seat or flexible rubber coupling. According to a particular embodiment of the disclosure, the lower portion of the support member can be received within a helical spring.

According to an embodiment of the disclosure, the base includes a storage recess for the housing. The base may also include a storage recess for the strikable object. In one form of the invention, the recess is formed on an underside of the base. The base may further include a removable cover for the recess. In one form of the present disclosure, the housing is configured to store the tether within the housing and the base is configured to store the strikable object and the housing. In this manner, the apparatus may be disassembled and conveniently stowed. The recess may be configured to correspond with the housing. For example, the recess may be shaped and sized to correspond with the shape and size of the housing. In this manner the housing can fit snugly within the recess and the recess does not occupy unnecessary volume within the base. Furthermore, the recess will not reduce potential ballast volume more than necessary.

The housing may include a battery compartment for receiving batteries to power the electronics of the apparatus. The apparatus could also be at least partially solar powered. For example, the housing may include a photovoltaic component such as a photovoltaic panel. The batteries within the battery compartment may be rechargeable. According to a particular embodiment, the apparatus may be configured for the batteries to be recharged using the photovoltaic component or using separate charging equipment.

As well as the PCB and sensor for measuring movement of the pivot member, the apparatus may include additional electrical componentry. For example, the housing may include a display screen for displaying game or training information.

The apparatus may further include an electronic processing device configured to receive from the sensor arrangement signals indicative of movement of the pivot member and to process the signals to determine one or more object parameters of the strikable object's motion. The processing device may be configured to determine one or more game parameters. For example, points, percentage of shots won, player score etc. The processing device may be configured to display the one or more determined object parameters or game parameters on the display screen. For example the game score or object speed may be displayed.

In an embodiment of the disclosure, the processing device may process data from the sensor arrangement in order to measure an indication of one or more parameters of the strikable object's motion. According to a particular embodiment, the processing device may perform calculations which assume that the tether is taut. According to a particular embodiment, the processing device is provided with predetermined data about the tether and/or strikable object. For example, the predetermined data may include the tether length, strikable object mass or strikable object drag coefficient. According to a particular embodiment, the length of the tether is 1 metre.

According to a particular embodiment, the processing device divides a circular game-play area around the game apparatus into four quadrants of 90° each. The positions of the four quadrants may correspond to the position of the pivot member such that the processing device records which of the four quadrants the pivot member arm (and therefore the tether) is currently in. The four quadrants may be designated quadrants 0, 1, 2 and 3 in sequential clockwise or anticlockwise order such that quadrants 0 and 2 are opposite one another and quadrants 1 and 3 are opposite one another. The number of players and the type of game may be inputted into the game apparatus such that the predetermined information provided to the processing device includes the number and location of the players.

According to a typical single player game of tetherball, the player may strike the strikable object (in the tetherball example, a ball) and the quadrant at which the ball is first struck can be designated quadrant 0. The ball will move through quadrants 1, 2 and 3 and then back into quadrant 0 where it will be struck again by the player but in the opposite direction. When the pivot member arm is detected as having entered quadrant 1, the processing device may start a timer which records the time taken for the pivot arm to move through one or more of the quadrants. The timer may be stopped when the pivot arm returns to quadrant 0. The processing device may therefore infer ball velocity based on the time taken for the pivot arm to move across one or more of the quadrants. The distance travelled may be a function of tether length which can be a predetermined and known parameter for the processing device.

A typical two player game of tetherball is described below. Upon inputting the number of players (two) and the type of game (tetherball) into the game apparatus, the sensor device records the number of players and game type as predetermined information. In a game of two player tetherball, players stand opposite one another. Player 1 stands in front of indicia such as a label reading 'Player 1' on the apparatus. Player 2 stands in front of indicia such as a label reading 'Player 2' on the apparatus. The processing device can thereby designate player 1 as quadrant 0 and player 2 as quadrant 2. During a game when the strikable object is first stuck by player 1 the object passes through one of quadrants 1 or 3 on the way to the player 2 location at quadrant 2. A timer may be started when the pivot member is pivoted into one of quadrants 1 or 3 and then stopped when the pivot member exits that quadrant at quadrant 2. Using the known length of the tether (for example, 1 metre) the processing device can infer the speed of the Player 1 hit based on the time taken for the pivot member to pivot across quadrants 1 or 3. Likewise, the speed of the player 2 hit can be inferred from the time taken for the pivot member to pass through quadrants 1 or 3, in a direction from quadrant 2 to quadrant 0

The processing device may form part of the PCB in the sensor arrangement. The processing device may be a microprocessor. The processing device may also be configured for wireless connectivity with a user client device and for determined parameters to be displayed on the user client device. For example, the processing device may be configured to display game or training information on a user's smart phone via an application or the like. The apparatus may be capable of interacting with the user via a tactile switch or button on the apparatus or via a user's wireless client device and for information to be digitally displayed to the user. The digital nature of the invention may enable the winner or loser of the game to be displayed, audibly announced or otherwise indicated digitally i.e., 1 without the players needing to keep track of game score. The apparatus may include one or more speakers to audibly announce game or training information or to generate an electronic sound such as a buzzer. According to a particular embodiment, the apparatus may be configured to wirelessly connect to a client device such a smartphone and the apparatus configured to generate a sound on the client device.

An apparatus according to the present disclosure may be provided with a corresponding software application available for use on the user client device. For example, the application may display game or training data during use or after a game or training sessions is completed. The software application may perform data analysis or calculation in order to display desire data for the user. For example, data processing may occur partially within the PCB of the apparatus and further processing may occur within the application. Alternatively, the unprocessed sensor data might be transmitted to the application and whereby all calculations are performed by the software application. According to a particular embodiment, the software application on the client device may show the on/off status, battery level and other game features.

The housing may include a capacitive switch for turning the apparatus on or off and/or for adjusting game parameters or adjusting information displayed on the display screen. The capacitive switch may include an LED to show on/off status as well as low battery capacity.

BRIEF DESCRIPTION OF DRAWINGS

In order that the present disclosure may be more fully understood, an embodiment of the present invention will now be described with reference to the figures in which:

FIG. 11 is an underside view of the base of FIGS. 9 and 10;

DETAILED DESCRIPTION

Figure 1:
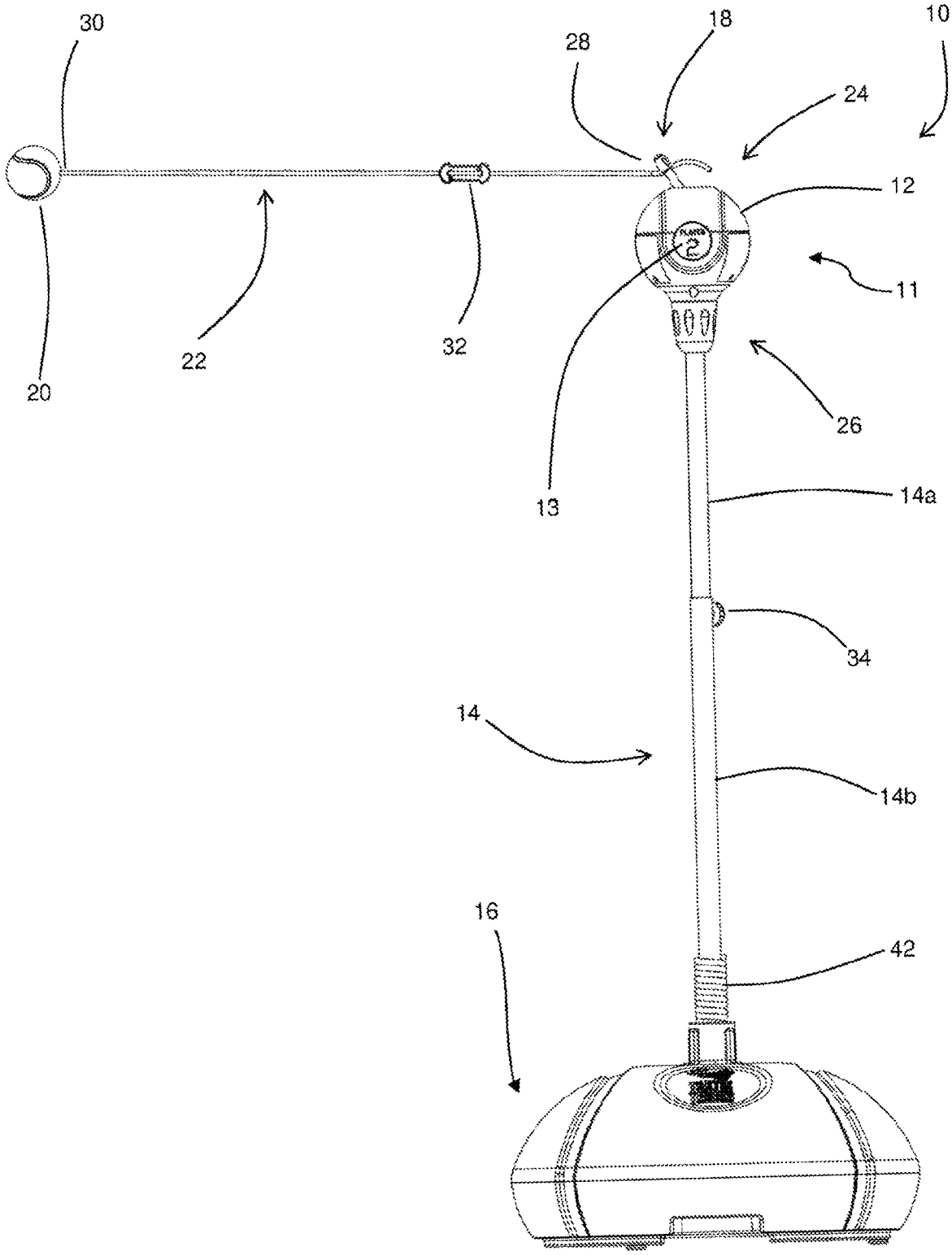
FIG. 1 is a side view of a tetherball apparatus according to the present disclosure.

FIG. 1 illustrates a tetherball apparatus 10 which includes a head assembly 11 comprising a top 24 and a bottom 26. The assembly 11 comprises a generally spherical housing 12. The assembly bottom 26 is mounted to an upper portion of a support post 14 extending from a base 16. A pivot member 18 is partially located within and extending from the assembly top 24 to the outside of housing 12.

A strikable object comprising a tennis ball 20 is connected via a tether 22 to the pivot member 18. In particular, a proximal end 28 of the tether 22 is coupled to the pivot member 18. A distal end 30 of the tether 22 is coupled to the ball 20. The distal end 30 may be coupled to the ball 20 via a rotatable coupling to avoid twisting of the tether 22. For example, the rotatable coupling may comprise a swivel. The tether comprises a flexible line formed of woven nylon cord. Depending on the particular application light cord material such as fishing line or similar lightweight tether may be suitable.

The support post 14 is a two-part telescope post comprising an outer member 14*b* engaged with the base 16 and an inner member 14*a* engaged with the bottom 26 of the assembly 11. The inner member 14*a* is telescopically received within the outer member 14*b* and the two parts 14*a*, 14*b* are secured relative to one another via a height adjustment knob 34. The height adjustment knob 34 facilitates length adjustment of the support post 14 to allow height adjustment of the assembly 11 relative to the base 16.

The base 16 includes a biasing means comprising a helical spring 42 in which the support post 14, in particular the outer member 14*b*, is received. The helical spring 42 absorbs impact during use of the apparatus 10 and reduces the possibility of the base 16 lifting or tipping.

Figures 2, 2A, 2B:
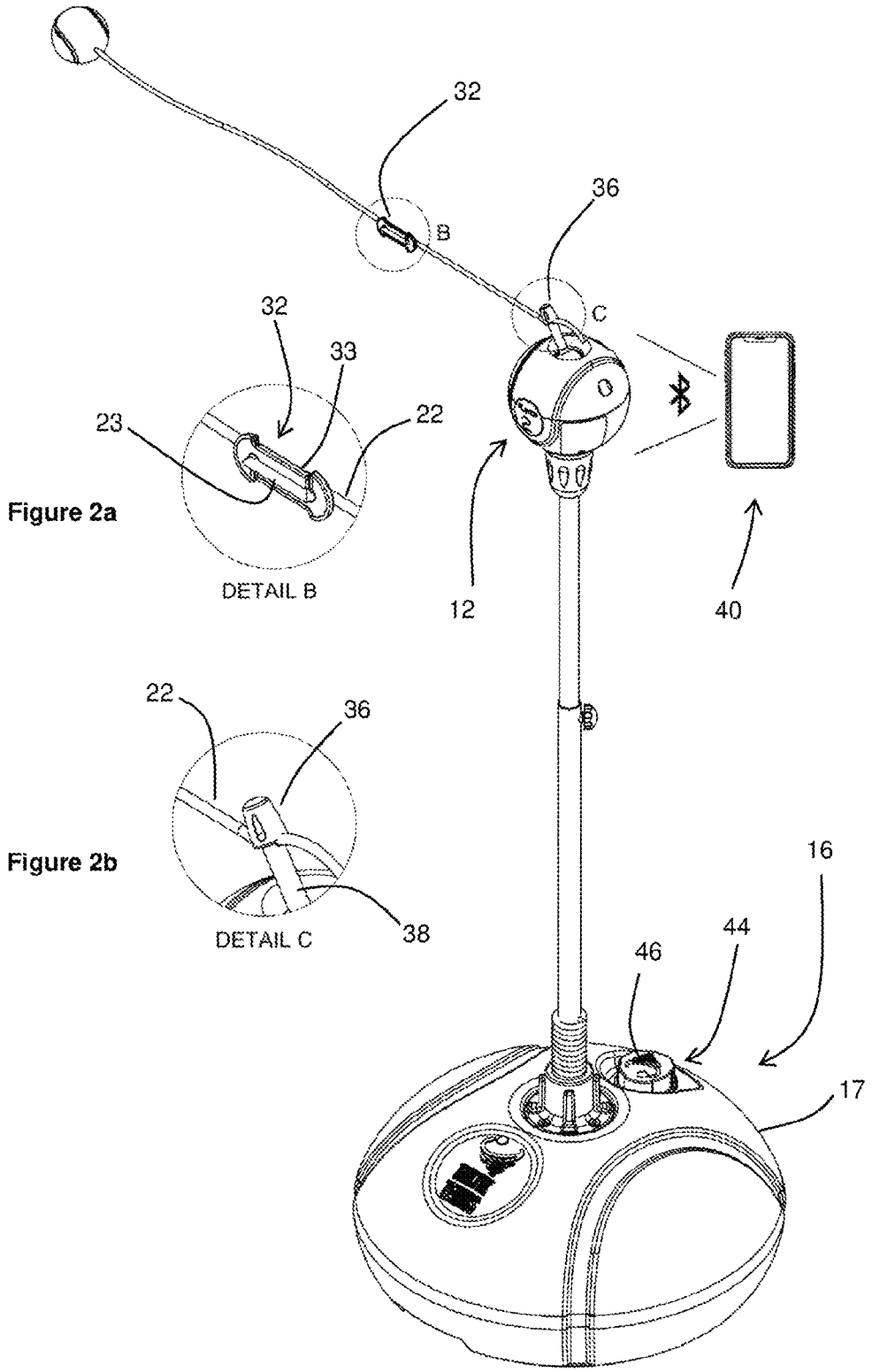
FIG. 2 is a perspective view of the tetherball apparatus of FIG. 1.
FIG. 2*a* is a closer perspective of a tether length adjustment device in FIG. 2.
FIG. 2*b* is a closer perspective of a tether clamp nut in FIG. 2.
Figure 14:
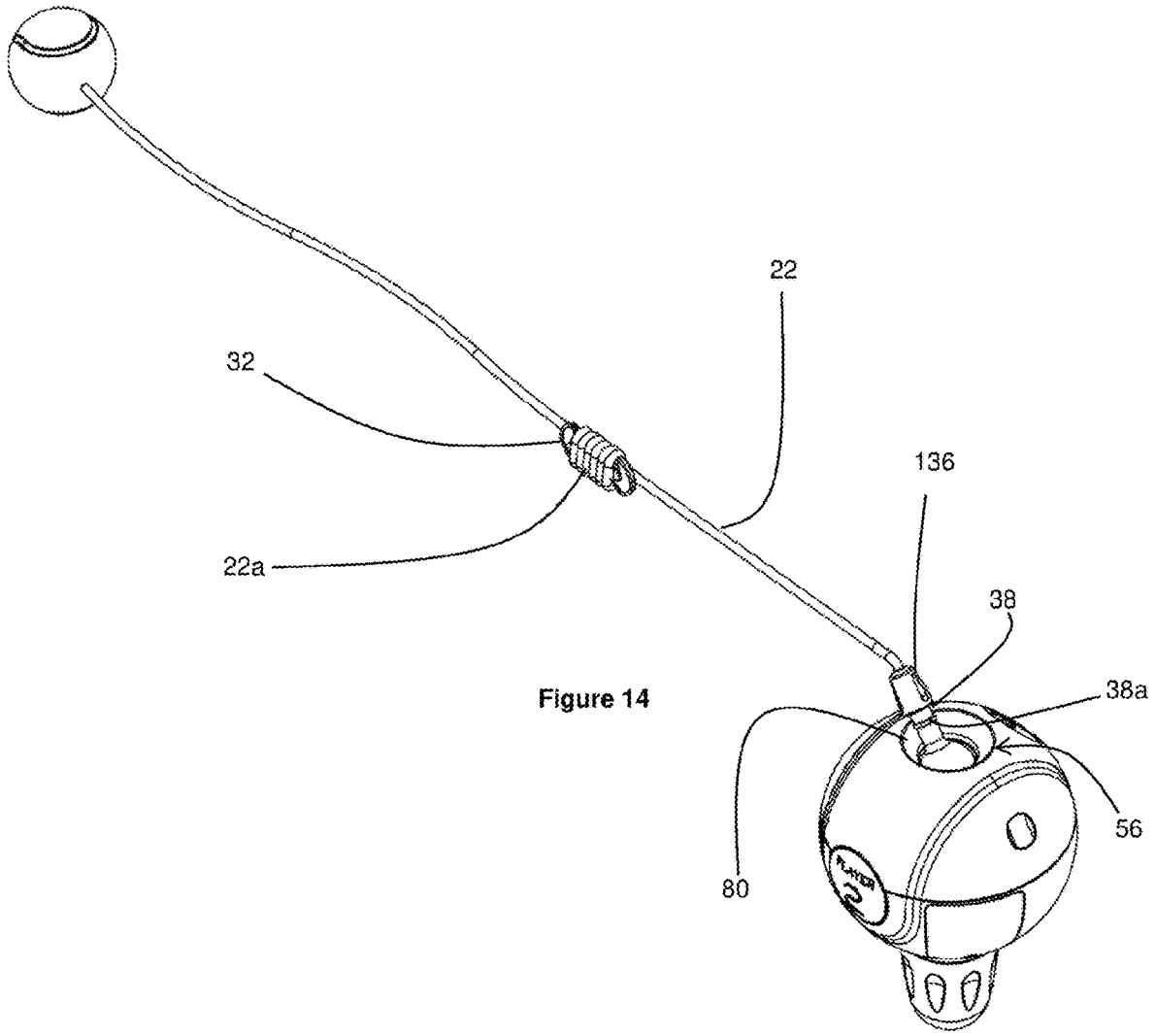
FIG. 14 is a perspective view of a housing and tether according to the present disclosure and shows an alternative embodiment of the tether clamp nut.

The tether includes a tether length adjustment device comprising a clip 32 which will be subsequently discussed in further detail with reference to FIG. 2 and FIG. 2*a*. FIG. 2*a* provides a closer perspective of the tether length adjustment device 32 shown in FIG. 2. As shown in FIG. 2*a*, the clip 32 creates a loop 23 of tether which wraps around a portion of the clip 32 to thereby shorten the operational length of the tether 22. By adding or removing loops to the clip 32, a user may adjust the tether length to a desired length. The clip 32 includes a flexibly resilient portion 33 which can be deflected to allow the clip 32 to be opened and for tether loops 23 to be conveniently added or removed. Operation of the tether length adjustment device is also shown in FIG. 14 in which tether loops 22*a* are wrapped around the clip 32 in order to shorten operational the length of the tether 22.

According to a particular embodiment, the tether adjustment device may include a flexible slot slightly narrower than a diameter of the tether. The tether may be looped around the adjustment device and secured in the slot. This advantageously allows for the tether to be easily shortened or lengthened by adding or removing loops to the adjustment device.

FIG. 2*b* illustrates a closer perspective of a tether clamp nut 36 shown in FIG. 2. The tether clamp nut 36 is threaded onto a pivot arm 38 to couple the tether 22 to the pivot arm 38. Loosening of the clamp nut 36 allows the tether 22 to be uncoupled to facilitate replacement of the tether 22.

FIG. 2 also illustrates a user client device comprising a smart phone 40 in a wireless connection (in particular, a Bluetooth connection) with the assembly 11. Data such may be transmitted from the assembly 11 to the smart phone 40 enabling a user to view game or training metrics on smart phone 40. In an alternative form of the disclosure, the wireless connection may comprise a WiFi connection.

The base 16 comprises a container 17 fillable with ballast material via an opening 44 which includes a threaded cap 46. The ballast material, for example water, enables the base 16 to be weighted down in order to prevent or reduce the possibility of tipping during use.

Figure 3:
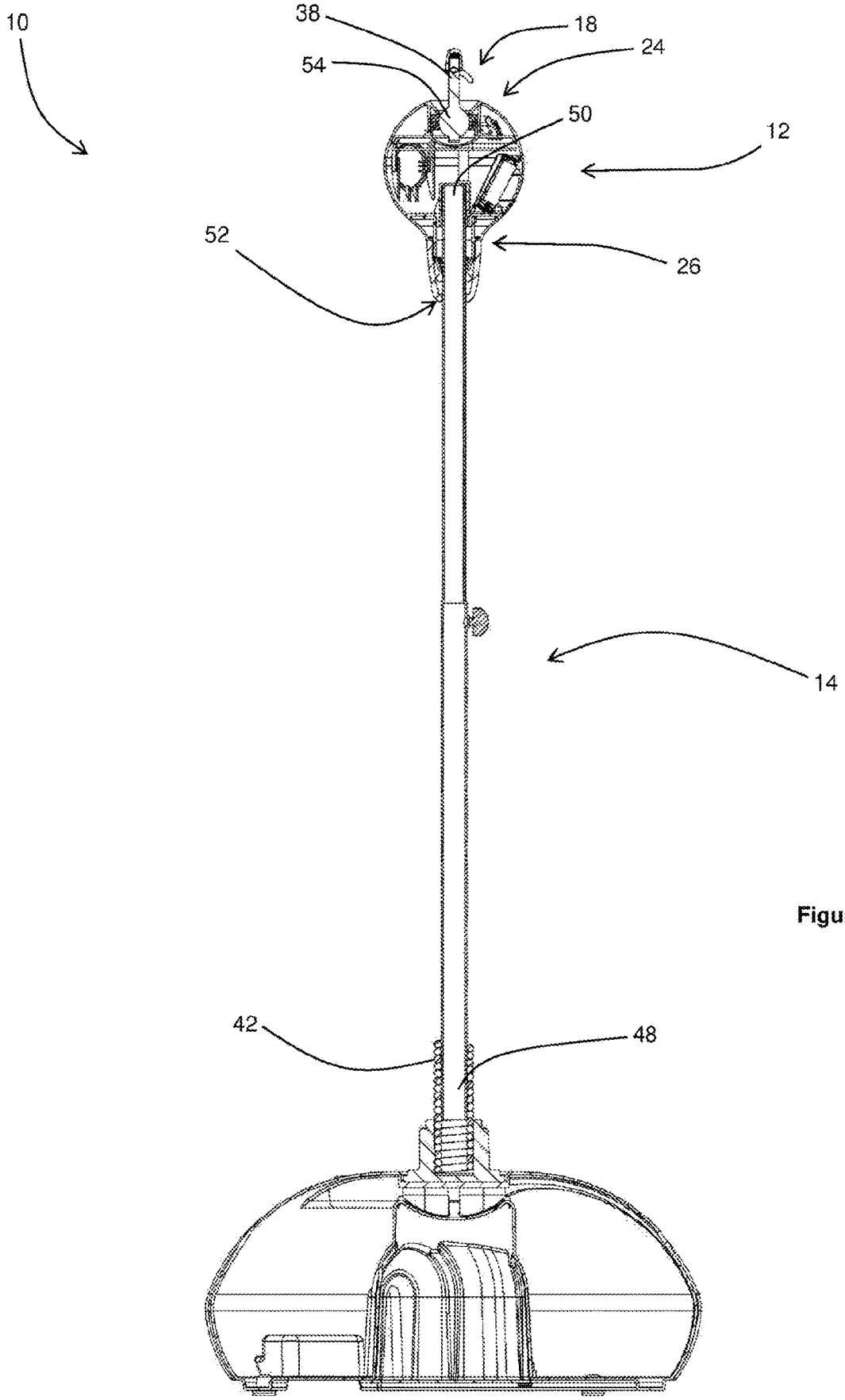
FIG. 3 is a side sectional view of the tetherball apparatus of FIG. 1.

Turning now to FIG. 3 there is provided a cross section of apparatus 10 which illustrates the lower end 48 of the support post 14 fitted within the helical spring 42. FIG. 3 also illustrates the upper portion 50 of the support post 14 received within a corresponding opening 52. The pivot member 18 is illustrated at an upper portion of and extending from the top 24 of the assembly 11.

Figure 4:
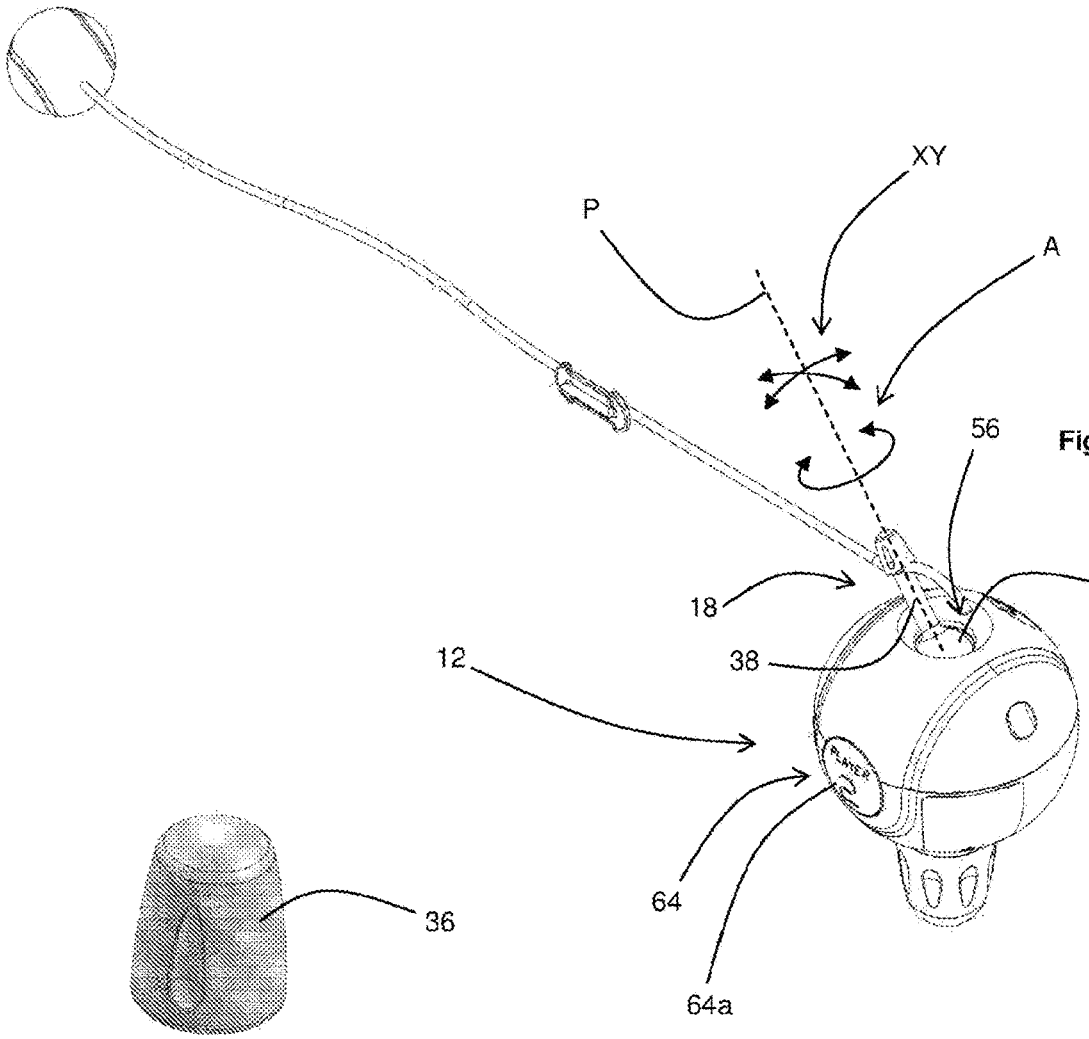
FIG. 4 is perspective of the housing and tether of the apparatus of the preceding figures.

As shown in FIG. 3, the pivot member 18 comprises a ball portion 54 and the pivot arm 38 which extends from the ball portion 54. Turning to FIG. 4, the ball portion 54 of the pivot member 18 is partially visible at the base of an opening 56 in the top 24 of the assembly 11. The pivot arm 38 extends through the housing opening 56 and projects outside of the housing 12. The housing opening 56 is flared outwardly and therefore increases in diameter from an inside (or lower end) of the housing opening 56 towards an outside (or upper end) of the housing opening 56. The housing opening 56 thereby defines a funnel-shaped or frustoconical passage which widens towards the top 24 of the assembly 11.

As shown in FIG. 4, the housing 12 also includes indicia 64 designating two sides of the housing 12 on which two opposing players are to stand. FIG. 4 illustrates indicia 64*a* corresponding to the side of the housing 12 on which Player 2 is to stand. The opposing side of the housing 12 is shown in FIG. 6 in which a second indicia 64*b* is illustrated which corresponds to the side of the housing on which player 1 is to stand.

Figure 5:
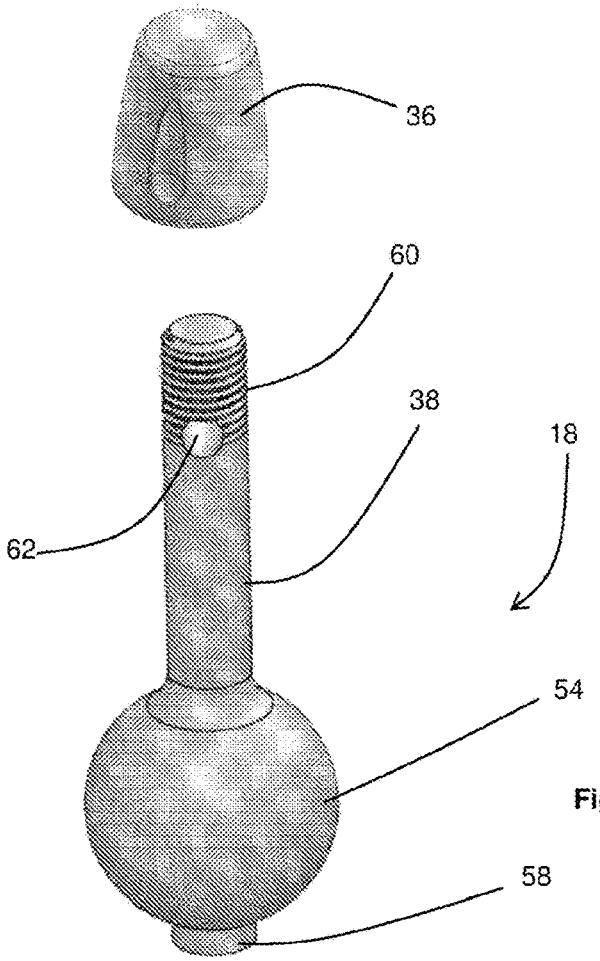
FIG. 5 is a perspective of the pivot member and clamp nut suitable for use in the apparatus of the preceding figures.

FIG. 5 illustrates the pivot member 18 and clamp nut 36 in isolation from the rest of apparatus 12. Ball portion 54 has a spherical configuration. Pivot arm 38 is generally cylindrical and extends from an upper side of the ball portion 54 and a projection 58 extends from a lower side of ball portion 54. The pivot arm 38 includes an external thread 60 at a distal end of the pivot arm 38. The external thread 60 is configured for threaded engagement with an internal thread (not shown) in the clamp nut 36. The pivot arm 38 further includes an opening 62 for receiving the tether before the clamp nut 36 is tightened onto the pivot arm 38 in order to couple the tether to the pivot arm 38.

Figure 6:
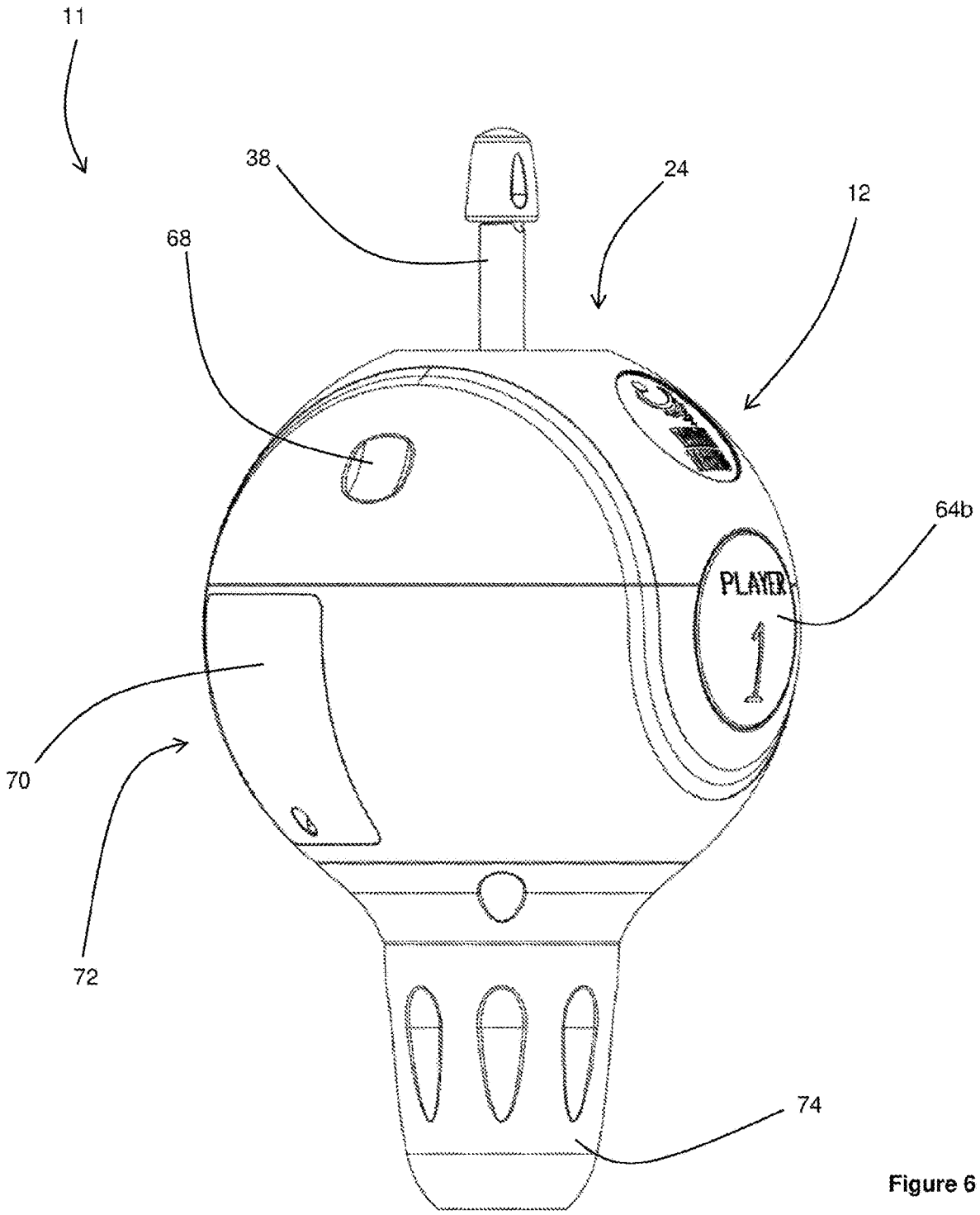
FIG. 6 is a side perspective of the housing in the apparatus of the preceding figures.

FIG. 6 illustrates a closer side perspective of the housing 12. The housing 12 includes a capacitive switch 68 for turning the apparatus 10 on or off. The capacitive switch 68 may include an LED to indicate the electronics are turned on and/or show battery capacity by flashing when battery capacity is low. FIG. 6 also illustrates the lid 70 of a battery compartment 72 in the housing 12 for powering the apparatus 10. The pivot arm 38 is cylindrical is visible protruding from the top 24 of the housing 12. FIG. 6 also illustrates a rotatable collar 74 at the base of the assembly 11 which will be discussed in further detail below.

Figure 7:
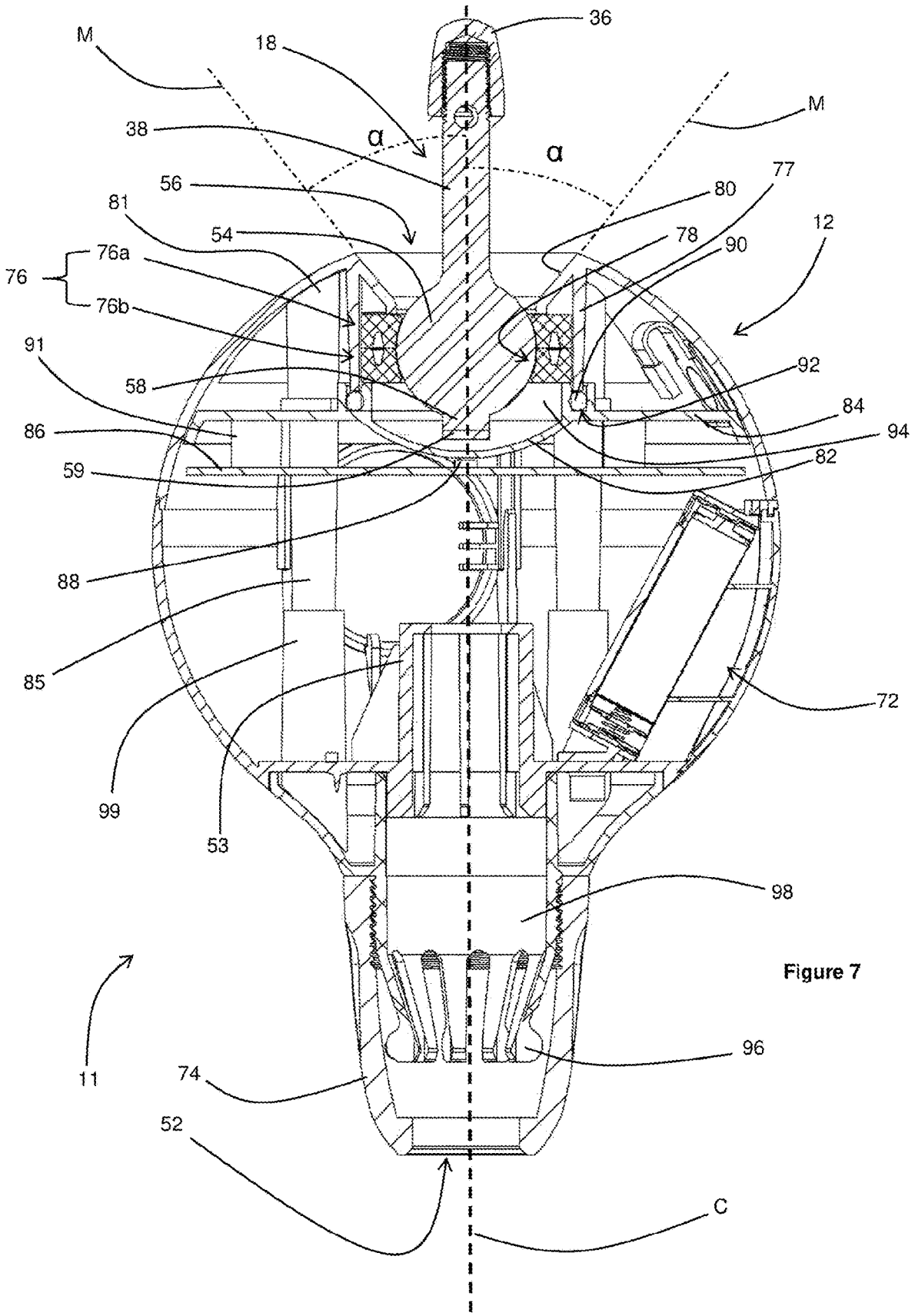
FIG. 7 is a side sectional view of the housing in FIG. 6 with the pivot member in a centred orientation.

FIG. 7 provides a cross sectional view of the assembly 11 which illustrates some of the components within housing 12. The assembly 11 has a central axis C extending longitudinally through the centre of the assembly 11 and also housing 12. The axis C extends centrally through the ball portion 54 of the pivot member 18. When the pivot member 18 is orientated in the upright position shown in FIG. 7, the central axis C also extends centrally through the pivot arm 38.

The ball portion 54 of the pivot arm 18 is seated within a socket comprising a two-part bearing 76 having an upper part 76*a* and a lower part 76*b*. Each bearing part 76*a*, 76*b* includes a concave surface 78 in contact with the outer surface of the ball portion 54. The bearing 76 is secured within the housing 12 beneath the housing opening 56 through which the pivot arm 38 extends. The pivot member 18 is therefore supported by and engaged with the bearing 76 to permit ball-and-socket or ball-joint movement of the pivot member 18, relative to the housing 12.

The housing opening 56 centrally located in the top 24 of the housing 12 such that central axis C extends through the centre of the housing opening 56. The housing opening 56 is flared outwardly towards the outside of the housing 12 and includes a surface 80 which is inclined relative to central axis C by an angle α. The inclination of surface 80 is indicated by reference lines M. In the illustrated form of the invention, the angle α between central axis C and surface 80 is approximately 40° The surface 80 surrounds the pivot arm 38 and defines the edge of the range of movement available for the pivot arm 38.

The inclined surface 80 therefore defines a conical or funnel-shaped movement zone in which the pivot arm 38 is permitted to move before the pivot arm will contact the surface 80. The pivot arm 38 is thus permitted to move freely within a conical zone defined by the opening 56 and generally indicated by the reference lines M. As evident from FIG. 7, the pivot arm 38 is therefore allowed a 2α or 80° range of movement from one side of the opening 56 to an opposing side of the opening 56.

It will be appreciated that angle α may vary depending on the sensitivity of the sensor and functional range of the magnet. In one form of the present disclosure, the angle α may be between 15-65°, more particularly between 20°-60°, more particularly between 25°-55°, more particularly between 30°-50° and more particularly angle α is approximately 40°.

Figure 7A:
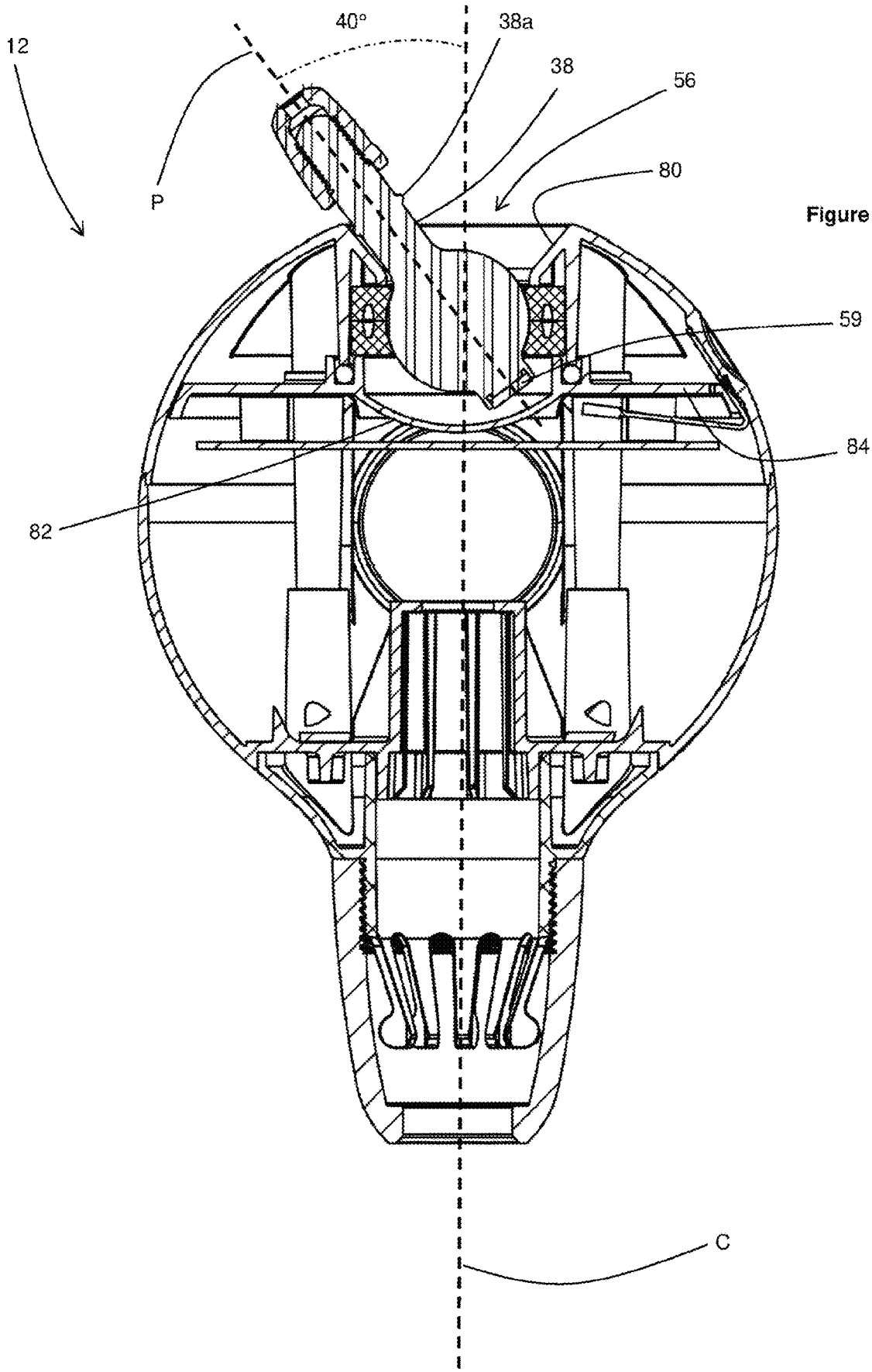
FIG. 7*a* is another side sectional view of the housing with the pivot member in a tilted orientation.

FIG. 7*a* illustrates the pivot arm 38 tilted to one side of the flared opening 56 and into contact with the inclined surface 80. According, in FIG. 7*a*, a longitudinal axis P of the pivot arm is tilted approximately 40° from central axis C. As shown in FIG. 7*a*, the magnet 59 is shifted to one side within the concave portion 82 of the PCB support 84. FIG. 7*a* shows angle α in FIG. 7 as being equal to 40°. Accordingly, the conical zone defined by the flared opening 56 has an angle of approximately 40° relative to a central axis C of the housing 12.

FIG. 7*a* illustrates a circumferential rib 38*a* formed on pivot arm 38 which provides a contact point with the surface 80. The rib 38*a* is also shown in FIG. 14. The rib 38*a* is intended to minimise the contact surface and therefore minimise friction between the pivot arm 38 and the surface 80 of the opening 56.

The ball and socket configuration allows the pivot arm 38 to move 360° around the edge of the surface 80 and side to side within the opening 56 i.e., in X-Y degrees of freedom. The ball and socket configuration also allows the pivot arm 38 to perform 360° rotation around a longitudinal or central axis of the pivot member 18 i.e., in a third degree of freedom. For example, the pivot arm 38 could remain aligned with central axis C as shown in FIG. 7 i.e., stationary in the X-Y planes but whilst rotating axially around an axis of the pivot member 38. The three degrees of freedom are best illustrated in FIG. 4 wherein the X-Y movement is labelled XY and axial rotation around an axis P of the pivot member 38 is labelled A.

Returning to FIG. 7, a neodymium magnet 59 is secured to an outer surface of the pivot member 18. Magnet 59 is located at the underside of the ball portion 54 and, in particular, is secured to an end of projection 58. The projection 58 and magnet 59 are positioned within a recess comprising a dish-shaped or concave portion 82 of a PCB (printed circuit board) support 84. The concave portion 82 is shaped to correspond with the range of movement available to the magnet 59. The concave portion 82 is spaced out of range from possible contact with the magnet 59 such that pivot member 18 may move freely without the possibility of contact with the PCB support 84.

The PCB support 84 is secured within the housing 12 and provides a mounting point for a PCB (printed circuit board) 86 secured to an underside of the PCB support 84. The PCB 86 is generally planar and is orientated perpendicular to central axis C of the housing 12. A tri-axis Hall effect sensor 88 is mounted centrally on an upper side of the PCB and approximately aligned with central axis C as shown in FIG. 7. The sensor 88 is located below the concave portion 82 and below magnet 59. The PCB support 84 is formed of moulded plastic and is positioned between the pivot member 18 and the PCB 86. The concave portion 82 is positioned between the magnet 59 and the sensor 88. The PCB support may therefore act as a barrier to weather, debris, grime, dirt etc. if it were to pass through the interface between the bearing 76 and the pivot member 18.

A seal comprising an O-ring is located within an annular channel 92 on the upper side of PCB support 64. The O-ring seals a volume 94 beneath the bearing 76 from the rest of the interior of the housing 12 such that any water or debris which passed through the interface of the ball portion 54 and the bearing 76 cannot ingress further into the housing interior to the PCB or other electrical componentry such as the battery compartment 72 which is also shown in FIG. 7. The PCB support 84 and O-ring 90 therefore separate the electronics from the ball and socket. Rain water caught within opening 56 can be simply emptied by inverting the housing 12.

The hall effect sensor 88 allows for contactless movement measurement of magnet 59. The hall effect sensor 88 may therefore operate whilst isolated from the magnet 59 by concave portion 82. According to a particular form of the invention, the hall effect sensor comprises an MLX 90393 magnetic sensor IC chip. During use, movement of the pivot member 18 induced by striking of the strikable object is detected and measured by the hall effect sensor 88 by measuring movement of the magnet 59. The triaxis hall effect sensor 88 is configured to measure X-Y movement as well as axial rotation of the pivot member 18 about an axis A of the pivot member 18 which is illustrated in FIG. 4.

Figure 8:
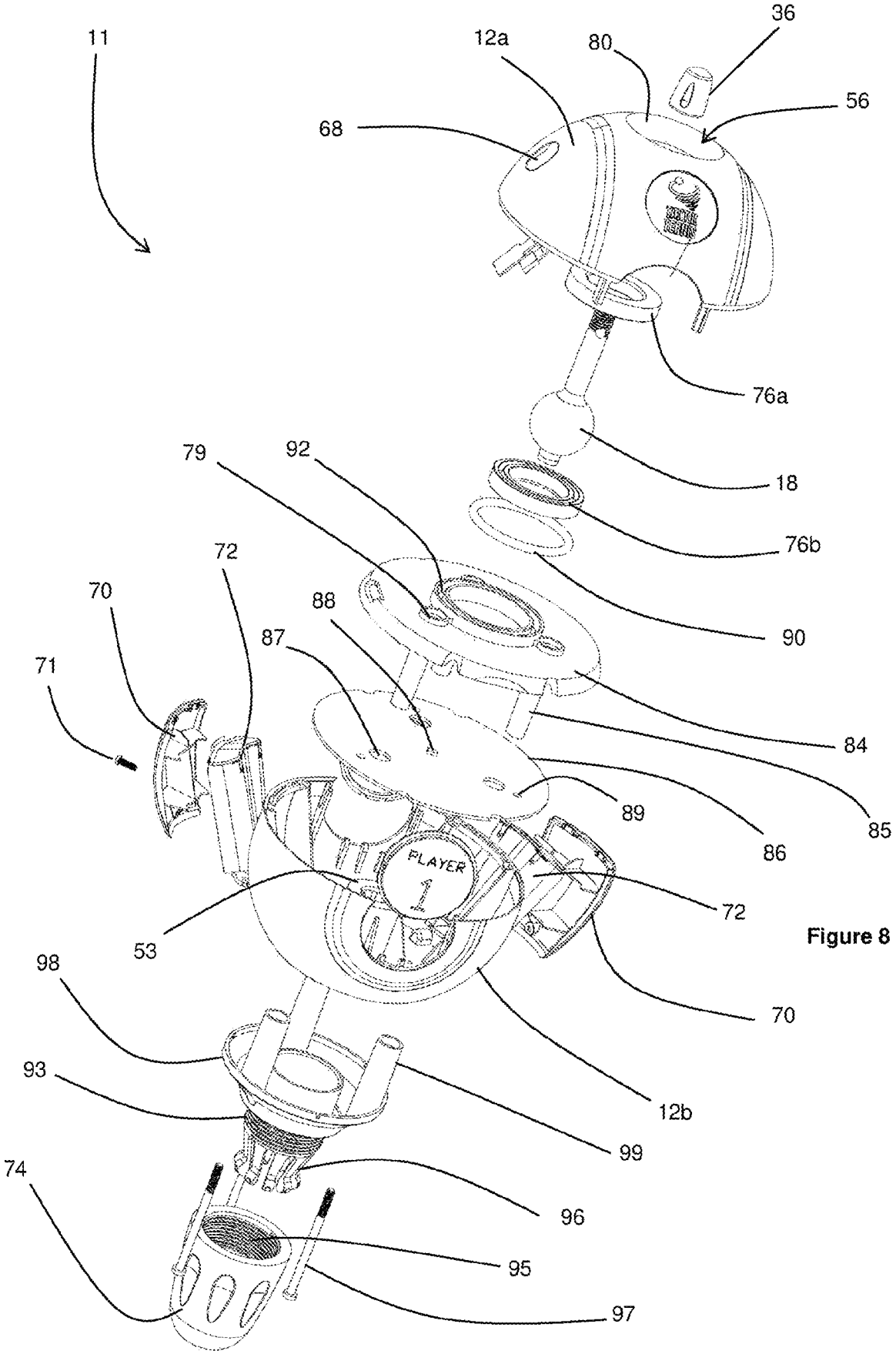
FIG. 8 is an exploded view of the housing from an upper angle.

FIGS. 7 and 8 illustrates a post socket 53 at the upper end of post opening 52. for receiving an upper portion 50 of the support post 14, as shown in FIG. 3. The assembly 11 includes a post clamp 98 positioned at the underside of the housing 12. The post clamp 98 includes a plurality of resilient fingers 96 which are positioned within rotatable collar 74 and surrounding a portion of post opening 52. The resilient fingers 96 are urged outward upon insertion of post 14 into post opening 52. The rotatable collar 74 is threadedly engaged with the post clamp 98 and as the rotatable collar 74 is tightened, the resilient fingers 96 are squeezed inward by the rotatable collar 74 so as to clamp against the support post 14 and thereby secure the housing 12 to the support post 14.

Figure 9:
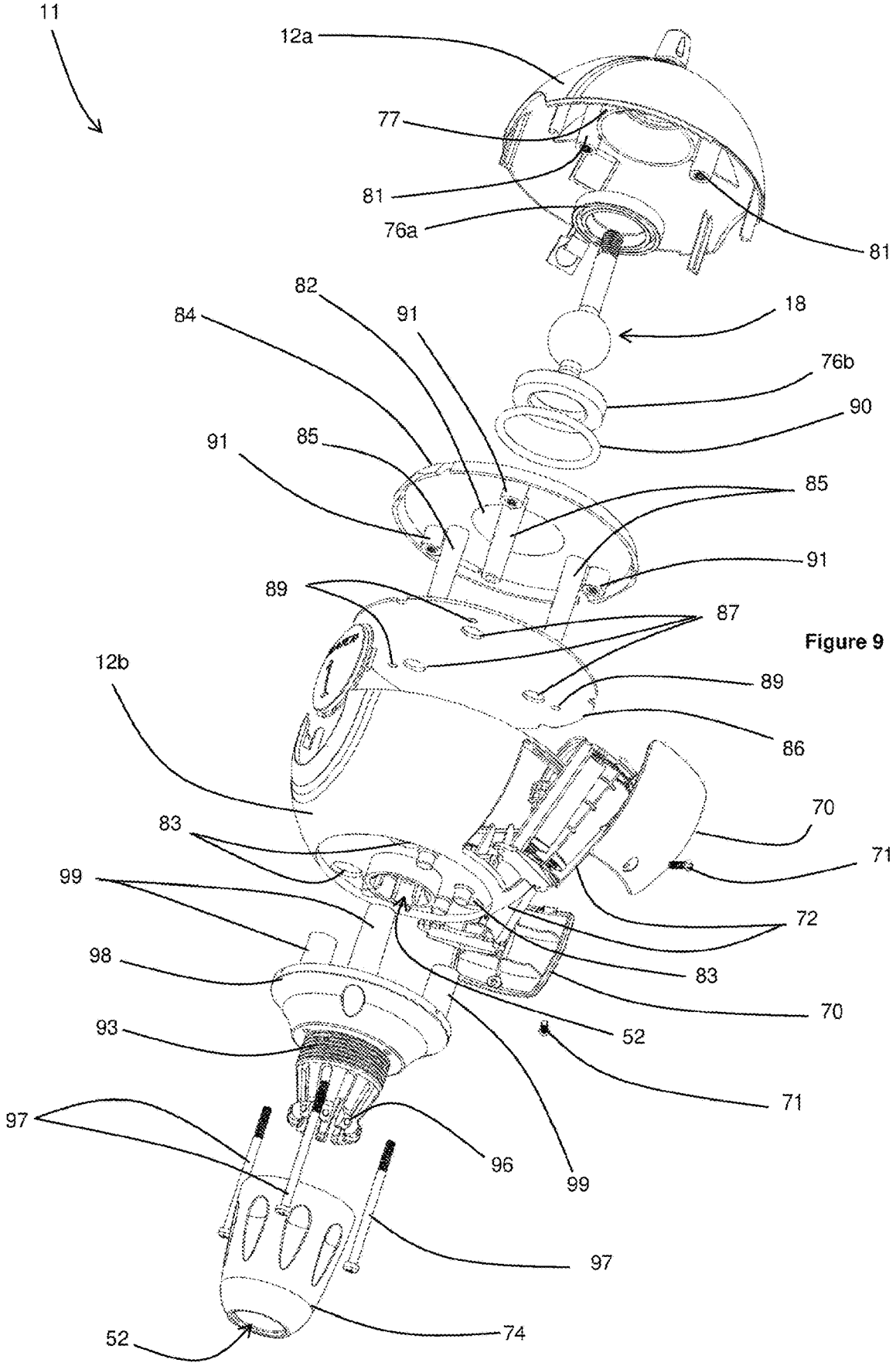
FIG. 9 is an exploded view of the housing of from a lower angle.

FIGS. 8 and 9 provide exploded views of a head assembly 11 which includes the housing 12 and the internal various components therein.

At the top of FIG. 8, the tether clamp nut 36 is shown above the flared opening 56 having inclined surface 80 formed in an upper housing part 12*a*. The pivot member 18 is positioned between upper bearing part 76*a* and lower bearing part 76*b*. The bearing 76 is locked within a downwardly extending hollow boss 77 formed in the upper housing part 12*a*. O-ring 90 is shown exploded from its seat within the channel 92 formed in an upper side of the PCB support 84. The hollow boss 77 is partially received within the channel 92 and seats upon O-ring 90. The boss 77 and concave portion 82 of the PCB Support 84 collectively form a water/dust barrier between the ball and socket configuration and the remainder of the interior of the housing 12.

At the bottom of FIG. 8, the rotatable collar 74 includes an internal thread 95 which engages with an external thread 93 on a post clamp 98. The resilient fingers 96 extend downwardly on a lower side of the post clamp 98 and into the collar 74. An upper side of the post clamp 98 includes three upwardly extending hollow protrusions 99. As best shown in FIG. 9, the hollow protrusions 99 extend through corresponding openings 83 in the base of a lower housing part 12*b*.

Still referring to FIG. 9, the PCB support 84 includes three downwardly extending long protrusions 85 and three downwardly extending short protrusions 91. The long protrusions extend through corresponding openings 87 in the PCB 86. The short protrusions 91 include an internal thread. The short protrusions 91 align with corresponding small openings 89 in the PCB 86 allowing the PCB 86 to be screwed to the underside of the PCB support 84 by three screws extending through the three small openings 89 and engaging with the internal threads in the three short protrusions 91. In this manner, the PCB 86 is spaced from the PCB support 84 by approximately the length of the short protrusions 91 which, as shown in FIG. 7, are slightly longer than the depth of the concave portion 82. The PCB 86 and the sensor 88 are thereby spaced below and slightly apart from the concave portion 82 of the PCB support 84.

The long protrusions 85 are hollow and align with the protrusions 99 extending upwardly from the post clamp 98 as is best shown in FIG. 7. The protrusions 85 each define a bolt passage having an upper opening 79 which is shown in FIG. 8. The openings 79 align with corresponding downwardly extending and internally threaded protrusions 81 in the upper housing part 12*a*, which are shown in FIGS. 9 and 7. The head assembly 11 is thereby secured via three bolts 97 inserted into post clamp 98 and which extend through the post clamp protrusions 99, the PCB long protrusions 85 and then engage with the internal threaded protrusions 81 in the upper housing part 12*a*.

As shown in FIG. 8, the lower housing part 12*b* includes two battery compartments 72 with corresponding battery compartment lids 70 secured via a corresponding battery lid screw 71. The battery lid screw 71 engages with an internally threaded boss on the lower housing part 12*b*. As illustrated in FIGS. 8 and 9, the bearing 76, PCB support 84 and PCB 86 are generally round.

The base 16 will now be described with reference FIGS. 10-12. The base 16 comprises a hollow container 17 of approximately 20 L volume which is fillable with ballast material, in particular water, via opening 19 which is closable via cap 21. The helical spring 42 is receiving within a spring mount 25 which is secured to the container 17 via bolts 27. The helical spring 42 spring operates to dissipate multidirectional loads when the ball 20 is struck and helps to reduce the possibility of the base 16 tipping off the ground.

Figure 11:
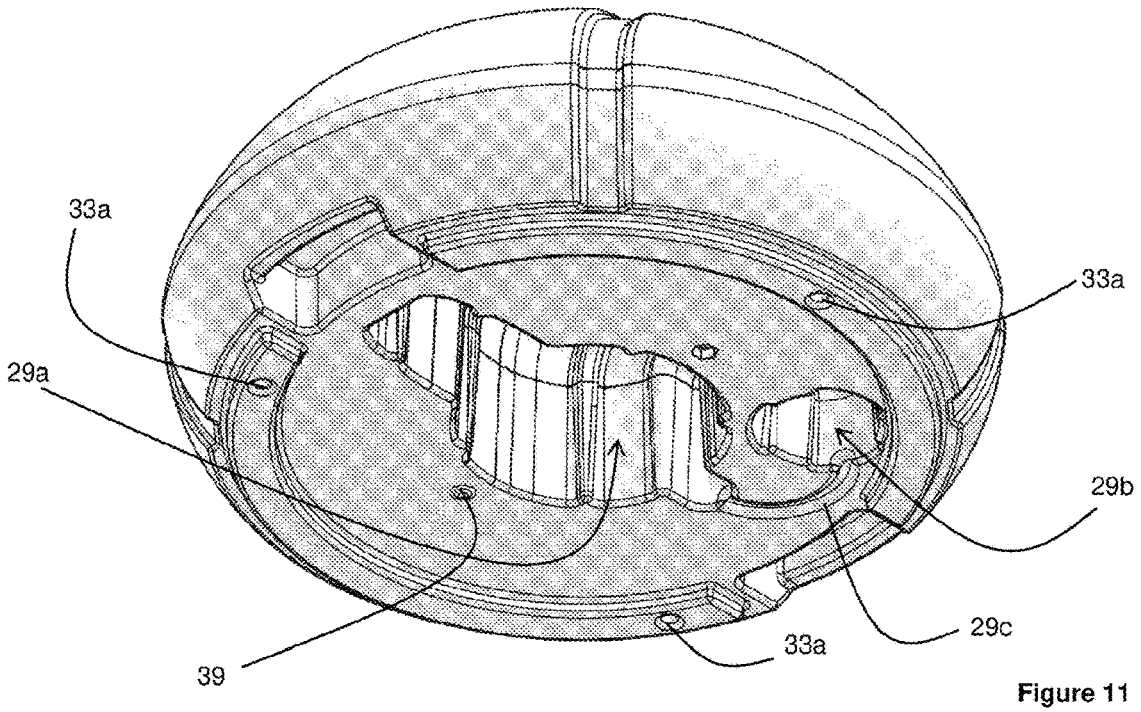
FIG. 11 is a lower perspective of the base of FIG. 10.

As shown in FIG. 11, the container 17 includes integrally formed storage recesses for containing parts of the apparatus 10. In particular, an underside of the container 17 of the base 16 includes a larger recess 29*a* for receiving the housing 12 and a smaller recess 29*b* for receiving the ball 20. The larger recess 29*a* and the smaller recess 29*b* are connected via a channel 29*c* for receiving part of the tether 22. During storage, the excess tether 22 can fit beneath the ball 20 in the smaller recess 29*b* and then feed along the channel 29*c* to the pivot member 18. The smaller recess 29*c* is sized to receive and secure the ball 20 via an interference fit within the recess 29*c*.

Figure 10:
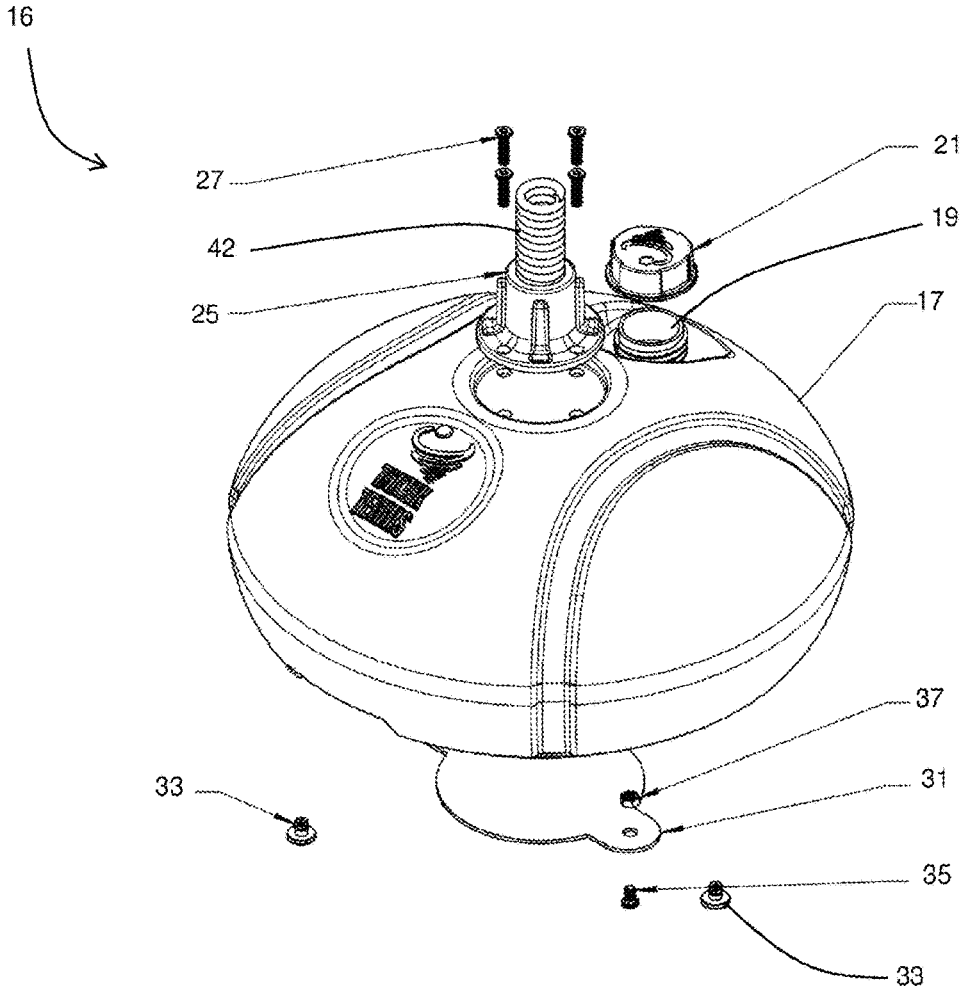
FIG. 10 illustrates a partially exploded view of the base of the apparatus illustrated in FIG. 1.
Figure 12:
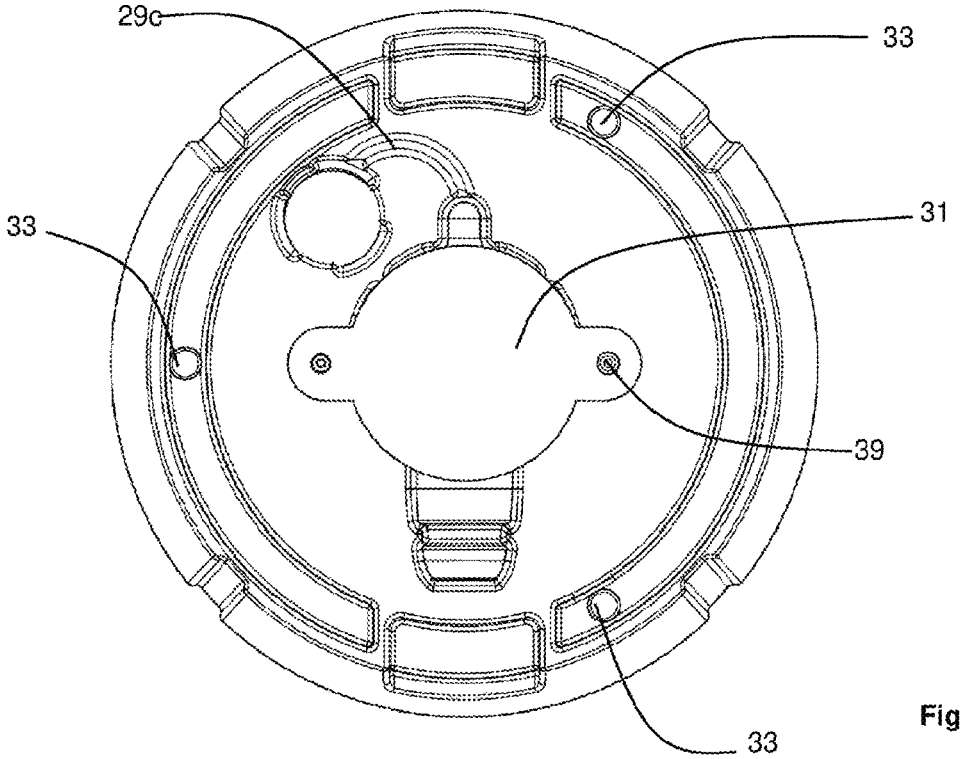
FIG. 12 is an underside view of the base of FIGS. 9 to 10.

A shown in FIGS. 10 and 12, a pivotable recess lid 31 covers the larger recess 29*a* for securing the housing 12 within the larger recess 29*a*. One side of the lid 31 is pivotably secured to the container 17 via a screw 35 and hex nut 37. The hex nut 37 is embedded in the underside of the container 17. In particular, the hex nut is fitted within a corresponding recess (for example a blind hole) formed in the underside of the container 17. In this way, the lid 31 can be held in place by screw 35 without forming a hole in the container which would cause leakage of ballast material. The lid 31 includes an opening which engages with a resilient raised projection 39 in the underside of the container 17. The lid 31 is flexed over resilient projection 39 to engage the opening in the lid with the projection 39 and thereby secure the lid 31 in a closed position over recess 29*a*. The base 16 includes non-slip rubber feet 33 shown in FIGS. 10 and 12 which are received within openings 33*a* shown in FIG. 11 and positioned equidistantly around the underside of the base 16.

Figure 13:
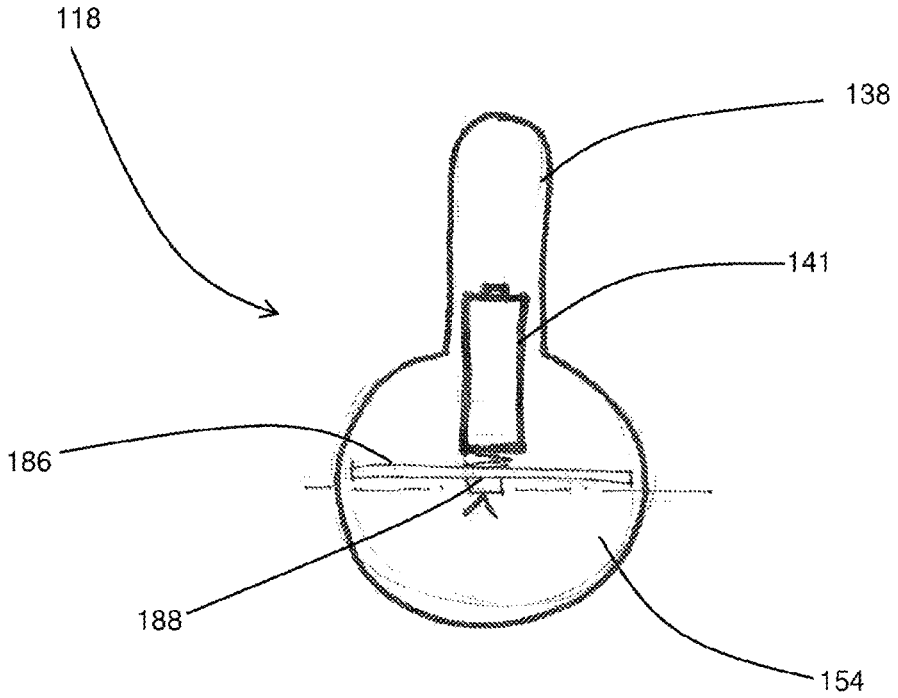
FIG. 13 is an alternative embodiment of a pivot member for use with the apparatus of the present disclosure.

FIG. 13 illustrates a self-contained pivot member 118 according to an alternative embodiment of the present invention in which the electrical componentry of the invention is self-contained within pivot member 118. In particular, the pivot member 118 includes a battery 141, a PCB 186 and an internal sensor 188. The PCB 186 may include a processing device and a wireless transmission device to communicate to a user's client device or to a display or speaker on the apparatus. The pivot member 118 is generally equivalent to pivot member 18 in its structure and similarly comprises a spherical ball portion 154 and a pivot arm 138 extending from the ball portion 154. By incorporating the electrical componentry of the apparatus into the pivot member 118, the overall size of the housing may be reduced. Furthermore, the apparatus may advantageous have increased weather resistance.

FIG. 14 illustrates another alternative embodiment of the invention comprising an alternative tether clamp nut 136. The tether clamp nut 136 includes a single opening at its top end through which the tether 22 extends. Inside the clamp nut 136, the proximal end of the tether 22 is clamped against the distal end of the pivot arm 38. This configuration may be preferable over the previously discussed and illustrated tether clamp nut 36 in which the tether 22 was fed through a side opening and involved a tether 'tail' which protruded through the nut. In contrast, tether clamp nut 136 does not require a tether tail. Furthermore, the tether 22 extends directly from the distal end of the clamp nut 136 and therefore the proximal end of the tether 22 aligns with the axis of the pivot arm 38 which potentially provides more natural movement of the pivot arm 18 in response to movement of the tether 22 during use.

Figure 15:
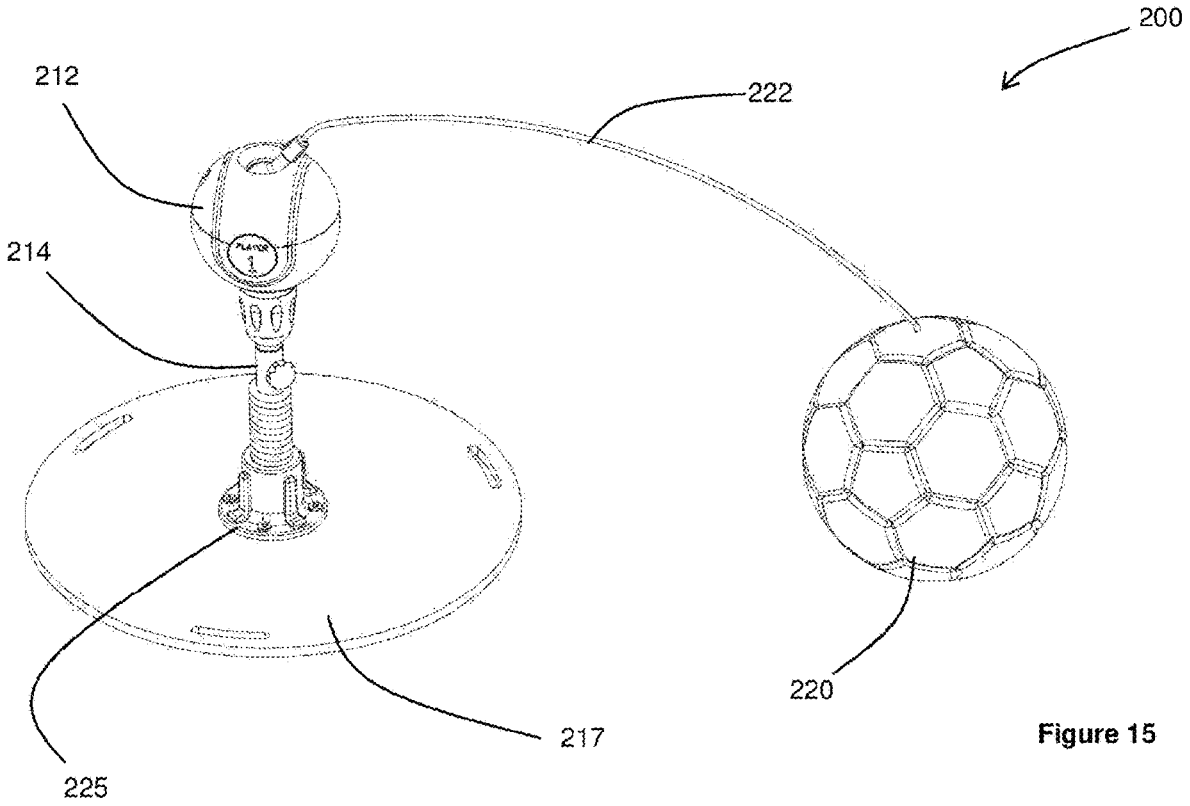
FIG. 15 illustrates a soccer training apparatus according to the present disclosure when used with a flat-type base.
Figure 16:
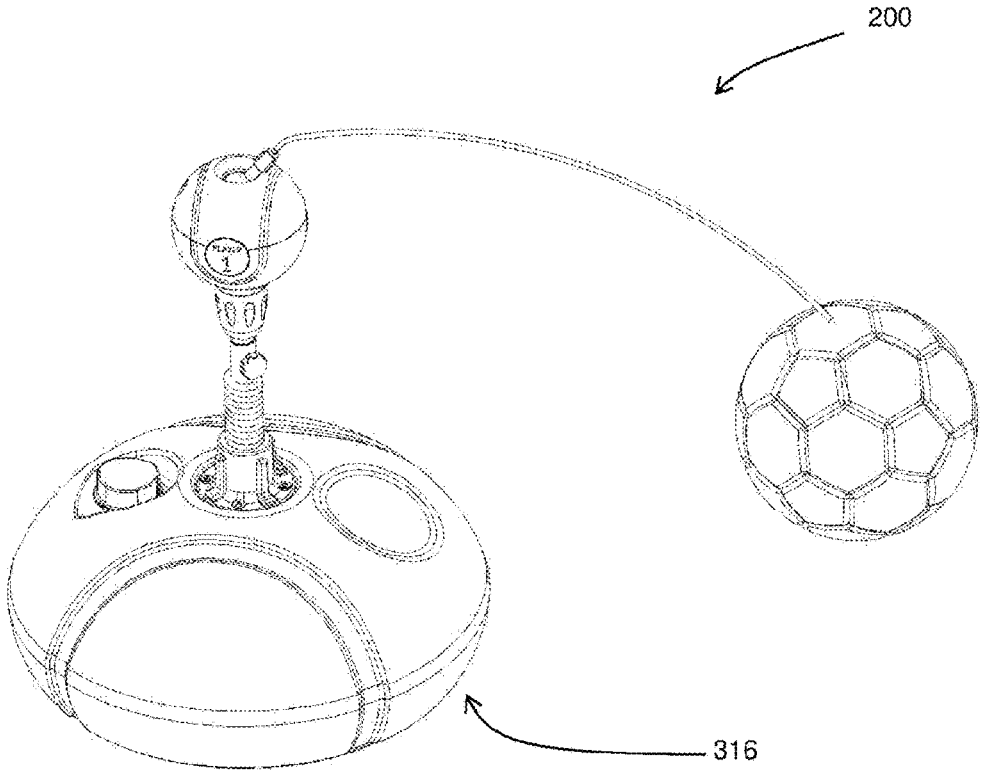
FIG. 16 illustrates a soccer training apparatus of the present disclosure when used with a ballast-type base.

As discussed in the foregoing, the present invention may be configured for a variety of games or as a training device for a variety of sports. FIGS. 15 and 16 illustrate embodiments of the present invention when configured as a soccer game or soccer training device. FIG. 15 illustrates an apparatus 200 in use with a flat base 216 in which the spring mount 225 is secured to a flat disc 217. The apparatus 200 includes a soccer ball 220 instead of tennis ball 20 used with apparatus 10. The apparatus 200 includes a shortened support post 214 so that housing 212 is at a height a soccer game or soccer training device. The tether 222 of apparatus 200 is also longer than the tether 22 of apparatus 10 to enable the soccer ball 220 to be kicked along the ground. The mechanical components of the assembly including the housing and the internal components thereof such as the pivot member and sensor arrangement, is otherwise equivalent in apparatus 200 to that of apparatus 10.

The apparatus 200 may also be used with a ballast-type base 316 as shown in FIG. 16. The base 316 may be generally equivalent to the base 16 described above in relation to apparatus 10 although the underside base 316 may not necessarily include a recess for storing the ball.

As discussed in the foregoing, each side of the head assembly 11 includes indicia to designate the player number. FIG. 6 illustrated indicia 64*b* which is a Player 1 label to indicate that the player standing on that side of the head assembly 11 will be designated player 1 by the processing device. As shown in FIG. 4, the opposite side of the head assembly 11 includes a player 2 indicia 64*a* which indicates that the player standing on that side of the head assembly 11 will be designated as player 2 by the processing device.

Figure 17:
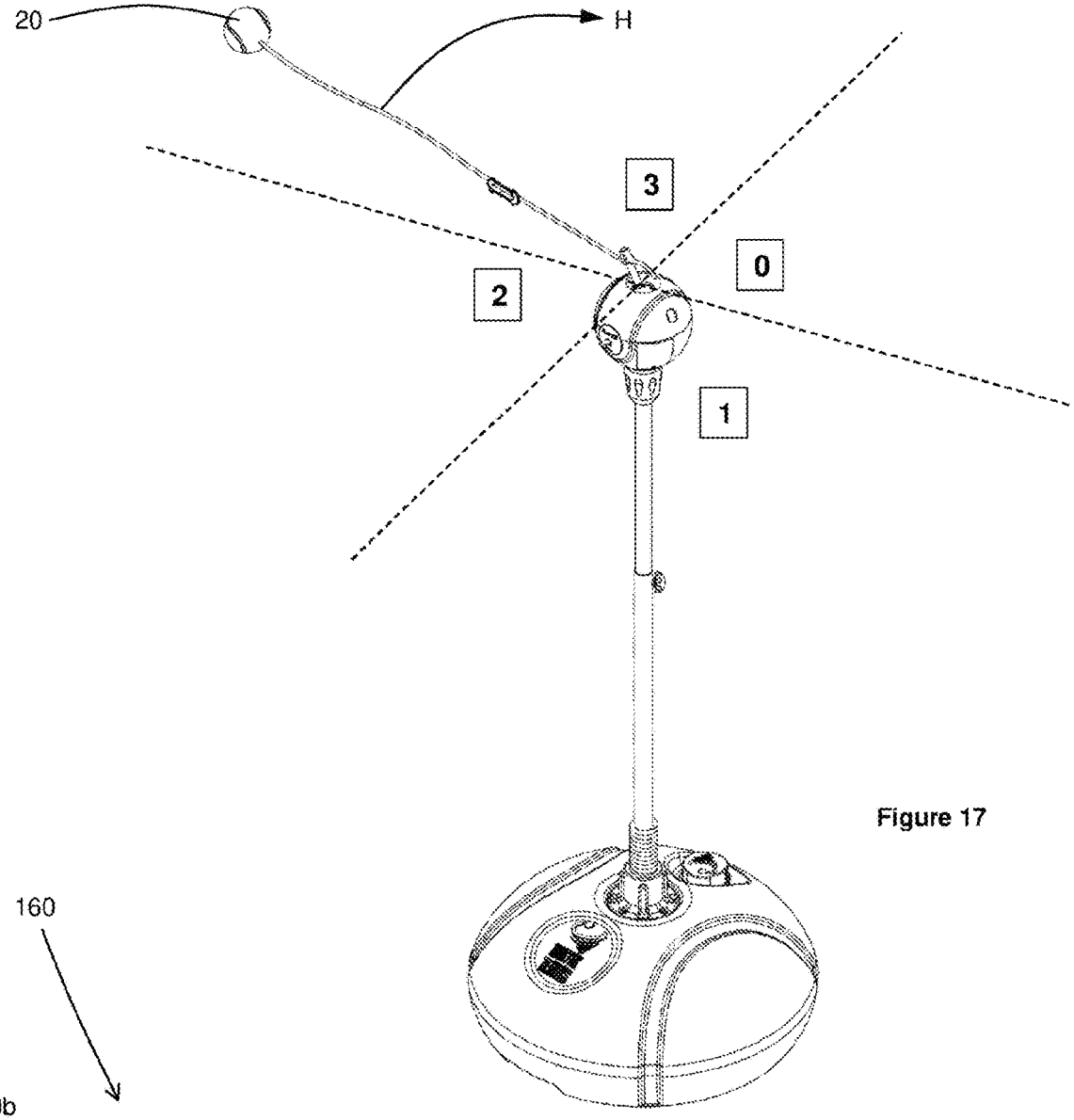
FIG. 17 is a perspective view of the tetherball apparatus of FIG. 1 with player quadrants annotated.

Turning to FIG. 17, the processing device notionally divides the playing area into four quadrants which are designated (in clockwise order) 0, 1, 2 and 3. The four quadrans are labelled in FIG. 17. A longitudinal axis (axis C shown in FIG. 7*a*) of the tetherball apparatus extends through the intersection of the four quadrants. Quadrants 0 and 2 correspond with the player 1 indicia 64*b* and the player 2 indicia 64*a* such that the player standing in front of the player 1 indicia is in quadrant 0 and the player standing in front of the player 2 indicia is in quadrant 2.

The processing device is configured to detect the position of the pivot arm with respect to the four quadrants. In the perspective shown in FIG. 17, the strikable object comprises a ball 20 which has been struck by player 2 (not shown) in quadrant 2 and is moving in the direction indicated by arrow H toward quadrant 3. Upon entering quadrant 3, the movement of the pivot arm into quadrant 3 triggers a timer in the processing device which is stopped when the pivot member crosses from quadrant 3 into quadrant 0. The time taken for the pivot member to traverse quadrant 3 is indicative of the time taken for the ball 20 to traverse quadrant 3 and this time recording is used to calculate an estimate of ball speed, based on an approximation of the distance travelled by the ball between entering and exiting quadrant 3.

According to a particular embodiment, the approximate distance travelled by the ball between entering and exiting quadrant 3 may be either predetermined or, alternatively, may be determined in use by the processing device based on the pivot member movement pathway. In the example of the distance being predetermined, the processing device may approximate the distance to $\pi/2$ or approximately 1.57 m, assuming a tether length of 1 m. This approximation assumes a relatively horizontal path of ball 20 and so may result in an underestimate of speed, for example, in the event that the ball path is diagonal. Accordingly, in an embodiment of the present disclosure, the processing device may be configured to also infer the vertical position of the ball as well as horizontal in order to provide a more accurate estimate of the distance travelled, and therefore a more accurate calculation of speed.

In an alternative embodiment, the processing device is configured to record position data of the pivot member at a rate of many times per second and can therefore determine velocity based on the rate of positional change over time. According to this method, the object acceleration can be estimated by recording the change in velocity over time.

When provided with the mass of the strikable object and the tether, an estimate of the force applied to the strikable object can be determined. This method of continual position recording may include recording vertical displacement as well as horizontal displacement and may therefore provide desirably accurate velocity calculations.

In a still further embodiment, the apparatus may be configured to infer a general indication of the strikable object's motion and to apply a 'gamification' factor to the inferred motion. For example, in order to improve gameplay excitement, the apparatus may apply a multiplication factor to the inferred motion. The apparatus may be configured to apply a 2× multiplication factor to the inferred speed of the strikable object so that presented speed is double the inferred speed. According to this particular configuration, the apparatus is not necessarily configured to display a precisely accurate motion measurement but is nonetheless configured to measure an indication of the object's motion. The multiplication factor may be used to enhance gameplay dynamics by increasing the speeds shown to the player(s). The multiplication factor may be used to display speeds closer to a ball in free-flight (i.e., not decelerated by the effects of the ball being tethered. The multiplication factor may be applied consistently to object strikes by both players 1 and 2 so that, the player with the higher recorded speed will still be presented with a higher indicated speed.

It will be appreciated that the software of apparatus 200 may be configured for the game of soccer whereas the software of apparatus 10 may be configured for the game of tetherball. Alternatively, common software may be present on either apparatus and the user is prompted to select which sport or game they intend to play.

Figure 18:
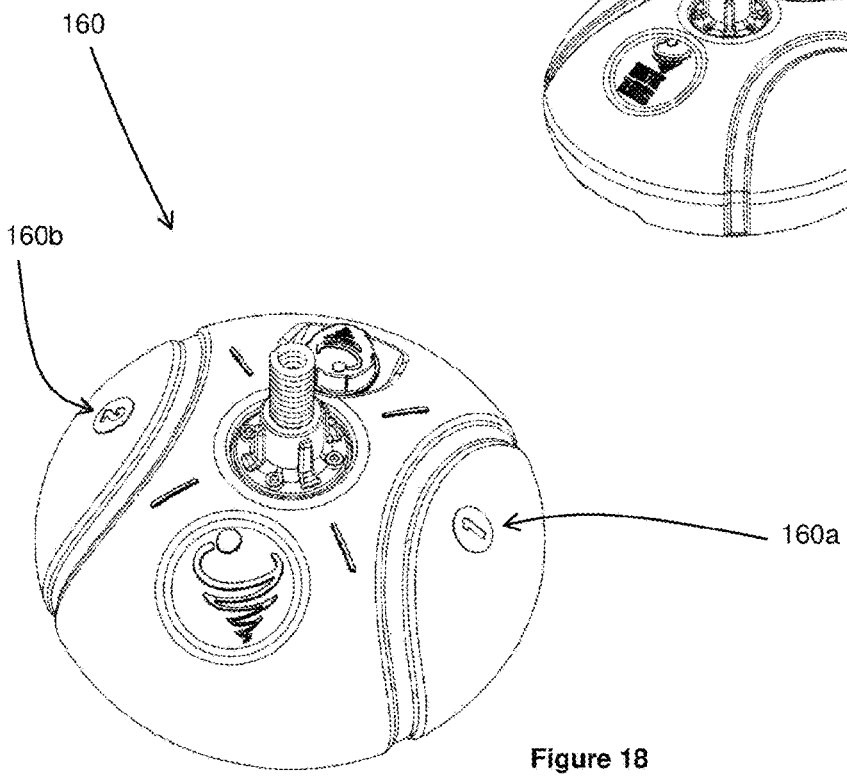
FIG. 18 is a perspective view of an embodiment of the base of the apparatus.

FIG. 18 illustrates a particular embodiment of a base 160 of the tetherball apparatus of the present disclosure. The base 160 includes indicia for players 1 and 2 which comprise markers 160*a* and 160*b* on opposite sides of the base 160. The player position markers 160*a*, 160*b* can be aligned with other indicia on the apparatus such as player position indicia on the head assembly of the apparatus.

It will be appreciated from the above discussion that the present disclosure advantageously provides a multi-axis pivot member capable of measuring multi-axis motion. Embodiments of the disclosure which provide contactless measurement advantageously provide a significant improvement as compared to previous systems that relied upon a rotary encoder which introduced friction into the system.

Those skilled in the art will appreciate that the disclosure described herein is susceptible to variations and modifications other than those specifically described. It is understood that the invention includes all such variations and modifications which fall within the spirit and scope of the present disclosure.

Where the terms "comprise", "comprises", "comprised" or "comprising" are used in this specification (including the claims) they are to be interpreted as specifying the presence of the stated features, integers, steps or components, but not precluding the presence of one or more other feature, integer, step, component or group thereof.

The invention claimed is:

1. A game apparatus including:

a housing;

a motion measurement arrangement at least partially located within the housing and comprising a multi-axis pivot member movable relative to the housing in at least two axes and a sensor arrangement for measuring multi-axis movement of the pivot member; and a flexible tether having a free end coupled to a strikable object and a proximal end coupled to the pivot member;

the motion measurement arrangement being configured to measure an indication of one or more parameters of the strikable object's motion upon striking of the strikable object by a user.

2. The apparatus according to claim 1, wherein the motion measurement arrangement further comprising a socket and the pivot member having a ball portion engaged with the socket in a ball and socket configuration.

3. The apparatus according to claim 1, wherein the motion measurement arrangement is configured to measure an indication of the strikable object's motion when travelling in an overhead trajectory, relative to the housing.

4. An apparatus according to claim 1, wherein the pivot member located at an upper portion of the housing.

5. An apparatus according to claim 2 wherein the ball portion is generally spherical.

6. The apparatus according to claim 2, wherein the sensor arrangement includes a sensor spaced apart from the pivot member and configured for contactless movement measurement of the pivot member.

7. The apparatus according to claim 6, wherein the sensor is a multi-axis hall effect sensor, wherein the sensor arrangement further includes a magnet, and wherein the sensor is configured to measure movement of the magnet, relative to the sensor.

8. The apparatus according to claim 6, wherein the sensor is secured relative to the housing and the magnet is arranged for movement with the pivot member, relative to the housing.

9. The apparatus according to claim 8, wherein the magnet is secured to a surface of the pivot member.

10. The apparatus according to claim 9, wherein the magnet is secured to a base of the pivot member, and wherein the sensor is secured to a PCB secured within the housing and located below the pivot member.

11. The apparatus according to claim 10, wherein the housing includes a dish-shaped barrier positioned between the pivot member and the PCB.

12. The apparatus according to claim 2, wherein the pivot member includes an arm extending from the ball portion and projecting outside of the housing, and wherein the proximal end of the tether is coupled to the arm.

13. The apparatus according to claim 12, wherein the arm extends through an opening in the housing and the ball and socket configuration permitting free movement of the arm within the opening.

14. The apparatus according to claim 13, wherein the opening is flared, and wherein the arm is permitted to move freely within a conical zone defined by the opening.

15. The apparatus according to claim 14, wherein the conical zone defined by the flared opening has an angle of approximately 40° relative to a central axis of the housing.

16. The apparatus according to claim 2, wherein the socket comprises a two-part bearing, each bearing part including a concave bearing surface for contacting the ball portion of the pivot member.

17. The apparatus according to claim 1, further comprising an electronic processing device configured to receive from the sensor arrangement signals indicative of movement of the pivot member and to process the signals to determine one or more object parameters of the strikable object's motion.

18. The apparatus according to claim 17, wherein the processing device is configured to determine one or more game parameters.

19. The apparatus according to claim 17, further comprising a display screen, and wherein the processing device is configured to display the one or more determined object parameters or game parameters on the display screen.

20. The apparatus according to claim 17 wherein the electronic processing device is configured for wireless connectivity with a user client device and for determined parameters to be displayed on the user client device.

* * * * *